US009156125B2

(12) United States Patent
Prasad

(10) Patent No.: US 9,156,125 B2
(45) Date of Patent: Oct. 13, 2015

(54) POLISHING PAD WITH LIGHT-STABLE LIGHT-TRANSMITTING REGION

(75) Inventor: Abaneshwar Prasad, Naperville, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 660 days.

(21) Appl. No.: 13/444,620

(22) Filed: Apr. 11, 2012

(65) Prior Publication Data

US 2013/0273813 A1 Oct. 17, 2013

(51) Int. Cl.
*B24B 37/24* (2012.01)
*B24B 37/20* (2012.01)

(52) U.S. Cl.
CPC ..... *B24B 37/205* (2013.01); *B24B 37/24* (2013.01)

(58) Field of Classification Search
CPC ..... B24B 37/013; B24B 37/205; B24B 37/24
USPC ..... 451/6, 533
See application file for complete search history.

(56) References Cited

U.S. PATENT DOCUMENTS 5,433,651 A * 7/1995 Lustig et al. ..... 451/6
5,605,760 A 2/1997 Roberts
5,824,738 A 10/1998 Humphrey et al.
5,893,796 A * 4/1999 Birang et al. ..... 451/526
5,964,643 A 10/1999 Birang et al.
6,106,662 A * 8/2000 Bibby et al. ..... 156/345.13
6,146,242 A * 11/2000 Treur et al. ..... 451/6
6,171,181 B1 * 1/2001 Roberts et al. ..... 451/527
6,537,134 B2 3/2003 Newell
6,559,266 B2 5/2003 Kaufhold et al.
6,607,422 B1 * 8/2003 Swedek et al. ..... 451/6
6,685,537 B1 * 2/2004 Fruitman et al. ..... 451/6
6,832,947 B2 12/2004 Manning
6,840,843 B2 1/2005 Jones et al.
6,884,156 B2 4/2005 Prasad et al.
6,896,593 B2 5/2005 Prasad
6,960,120 B2 * 11/2005 Prasad ..... 451/41
6,984,163 B2 * 1/2006 Roberts ..... 451/6
6,997,777 B2 2/2006 Newell
7,147,923 B2 * 12/2006 Roberts et al. ..... 428/423.3
7,183,213 B2 2/2007 Shiho et al.
7,195,539 B2 3/2007 Turner et al.
7,198,544 B2 * 4/2007 Wiswesser ..... 451/5
7,204,742 B2 4/2007 Prasad
7,226,339 B2 6/2007 Benvegnu et al.
7,264,641 B2 9/2007 Prasad
7,291,063 B2 * 11/2007 Swisher et al. ..... 451/533
7,306,507 B2 12/2007 Benvegnu et al.
7,406,394 B2 7/2008 Swedek et al.
7,435,165 B2 10/2008 Prasad
7,614,933 B2 11/2009 Benvegnu et al.
7,614,936 B2 11/2009 Benvegnu et al.
7,704,125 B2 4/2010 Roy et al.
7,764,377 B2 7/2010 Benvegnu et al.
7,871,309 B2 1/2011 Ogawa et al.
2001/0031610 A1 * 10/2001 Budinger et al. ..... 451/41
2001/0053841 A1 12/2001 Kaufhold et al.
2004/0063391 A1 4/2004 Hosaka et al.
2004/0203320 A1 10/2004 Hosaka et al.
2009/0042480 A1 2/2009 Shiro et al.
2010/0162631 A1 7/2010 Sato et al.
2010/0221984 A1 9/2010 Doura et al.
2011/0053377 A1 3/2011 Ogawa et al.
2011/0171883 A1 7/2011 Allison et al.
2012/0077418 A1 * 3/2012 Loyack et al. ..... 451/6

OTHER PUBLICATIONS

CIBA Specialty Chemicals, ® *Tinuvin P Benzotriazole UV Absorber*, pp. 1-2 (Aug. 1998).
Lubrizol Corporation, *Carbothane® TPU-Clear* (Feb. 2011).
BASF Aktiengesellschaft, *Uvinul® 3030 UV Absorber for Plastics and Paints* (Ludwigshafen, Germany), pp. 1-5 (Jun. 1999).
BASF Aktiengesellschaft, *Uvinul® 3088 UV Absorber for Thermoplastics and Elastomers* (Ludwigshafen, Germany), pp. 1-6 (Jul. 1999).

* cited by examiner

*Primary Examiner* — Lee D Wilson
*Assistant Examiner* — Tyrone V Hall, Jr.
(74) *Attorney, Agent, or Firm* — Thomas Omholt; Arlene Hornilla

(57) ABSTRACT

The invention provides a polishing pad that contains at least one light-transmitting region and optionally a polishing pad body. The light-transmitting region is composed of a material comprising (a) a polymeric resin and (b) at least one light-absorbing compound, and the light-transmitting region has a total light transmittance of about 25% or more at one or more wavelengths in a range of 250 nm to 395 nm.

25 Claims, 7 Drawing Sheets

POLISHING PAD WITH LIGHT-STABLE LIGHT-TRANSMITTING REGION

BACKGROUND OF THE INVENTION

Chemical-mechanical polishing ("CMP") processes are used in the manufacturing of microelectronic devices to form flat surfaces on semiconductor wafers, field emission displays, and many other microelectronic substrates. For example, the manufacture of semiconductor devices generally involves the formation of various process layers, selective removal or patterning of portions of those layers, and deposition of yet additional process layers above the surface of a semiconducting substrate to form a semiconductor wafer. The process layers can include, by way of example, insulation layers, gate oxide layers, conductive layers, layers of metal or glass, etc. In certain steps of the wafer fabrication process, the uppermost surface of the process layers are desirably planar, i.e., flat, for the deposition of subsequent layers. CMP is used to planarize process layers wherein a deposited material, such as a conductive or insulating material, is polished to planarize the wafer for subsequent process steps.

In a typical CMP process, a wafer is mounted upside down on a carrier in a CMP tool. A force pushes the carrier and the wafer downward toward a polishing pad. The carrier and the wafer are rotated above the rotating polishing pad on the CMP tool's polishing table. A polishing composition (also referred to as a polishing slurry) generally is introduced between the rotating wafer and the rotating polishing pad during the polishing process. The polishing composition typically contains one or more chemicals that interact with or dissolve portions of the uppermost wafer layer(s) and one or more abrasive materials that physically remove portions of the layer(s). The wafer and the polishing pad can be rotated in the same direction or in opposite directions, whichever is desirable for the particular polishing process being carried out. The carrier also can oscillate across the polishing pad on the polishing table.

In polishing the surface of a wafer, it is often advantageous to monitor the polishing process in situ with an end-point detection (EPD) system, e.g., to determine when a desired degree of planarization has been attained. One method of monitoring the polishing process in situ involves the use of a polishing pad having a light-transmitting region, such as an aperture or window, having translucency to light. This light-transmitting region provides a portal through which light can pass to allow the inspection of the wafer surface during the polishing process. The light-transmitting region must have sufficient light transmittance at one or more wavelengths in order for light to pass through the light-transmitting region and be detected by the EPD system.

Polishing pads having light-transmitting regions, such as apertures and windows, are known and have been used to polish substrates, such as the surfaces of semiconductor devices. For example, U.S. Pat. No. 7,614,933 discloses a polishing pad comprising a window that can be made of a rigid crystalline material, such as quartz or glass, or a softer polymeric (plastic) material, such as polyurethane. When the light-transmitting region contacts the substrate that is to be polished, polymeric materials are especially preferred so as to prevent problems that could occur when a harder window material (e.g., glass) contacts the substrate, such as, e.g., scratching of the substrate and/or light-transmitting region. The polishing pad typically is made of a polymeric material that can be the same or different from the polymeric material comprising the light-transmitting region.

Conventional EPD systems typically utilize light having a wavelength in the range of 400-690 nm, roughly corresponding to light in the visible spectrum. Newer EPD systems boast higher accuracy by employing white light comprised of both ultraviolet and visible components (e.g., about 300 nm to 800 nm), such as the FULLVISION in situ endpoint detection (EPD) system available from Applied Materials, Inc. However, conventional soft polymeric materials typically used in CMP polishing pads have poor light transmitting properties in the ultraviolet range. Moreover, these conventional materials also are highly susceptible to degradation by ultraviolet light, such that yellowing and/or brittleness can occur over time. For example, when a polishing pad comprised of a conventional polyurethane is exposed to ultraviolet light, the polyurethane will gradually degrade and crosslink, causing the polyurethane to yellow. Even ambient light can be sufficient to cause yellowing of these materials, such that special precautions must be observed when handling and/or storing polishing pads comprising conventional polymeric materials. Yellowing of the polymeric materials that comprise the light-transmitting region of a polishing pad can be especially detrimental to the functioning of EPD systems that utilize light, since these EPD systems rely on precisely monitoring changes in the wavelength and/or intensity of light passing through the light-transmitting region. In this respect, any yellowing or color change of the light-transmitting region can complicate accurate analysis of the detected light, thereby requiring, for example, frequent recalibration of the EPD system and/or replacement of the degraded polishing pad with a new polishing pad, thereby adding to the overall production time and costs.

Thus, there remains a need in the art for improved polishing pads for use in EPD systems, which polishing pads comprise, inter alia, a polymeric light-transmitting region having sufficient white (i.e., ultraviolet and visible) light-transmittance and improved stability to ultraviolet light.

BRIEF SUMMARY OF THE INVENTION

The invention provides a polishing pad comprising at least one light-transmitting region, wherein the light-transmitting region is composed of a material comprising, consisting of, or consisting essentially of (a) a polymeric resin and (b) at least one light-absorbing compound, wherein the light-transmitting region has a total light transmittance of about 25% or more at one or more wavelengths in a range of 250 nm to 395 nm. The polishing pad further comprises a polishing pad body when the polishing pad does not consist of the light-transmitting region.

The invention also provides a method of polishing a workpiece comprising the steps of (a) providing a workpiece to be polished, (b) contacting the workpiece with a polishing pad and a chemical-mechanical polishing composition, and (c) moving the workpiece relative to the polishing pad so as to abrade at least a portion of the surface of the workpiece to polish the workpiece, wherein the polishing pad comprises at least one light-transmitting region, the light-transmitting region is composed of a material comprising, consisting of or consisting essentially of (i) a polymeric resin and (ii) at least one light-absorbing compound, and the light-transmitting region has a total light transmittance of about 25% or more at one or more wavelengths in a range of 250 nm to 395 nm. The polishing pad further comprises a polishing pad body when the polishing pad does not consist of the light-transmitting region.

DETAILED DESCRIPTION OF THE INVENTION

Figure 1A:
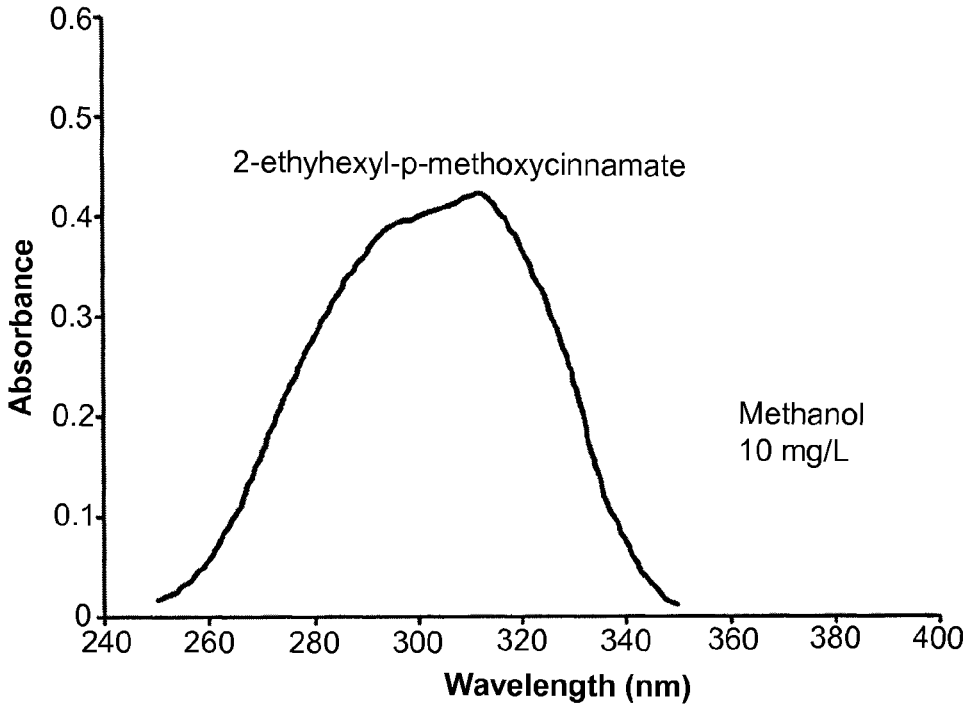
FIG. 1A and FIG. 1B depict ultraviolet-visible spectra of light-absorbing compounds suitable for use in the material comprising the light-transmitting region of the invention.

The invention provides a polishing pad comprising at least one light-transmitting region, wherein the light-transmitting region is composed of a material comprising (a) a polymeric resin and (b) at least one light-absorbing compound, and wherein the light-transmitting region has a total light transmittance of about 25% or more at one or more wavelengths in a range of 250 nm to 395 nm. While the polishing pad can consist of the light-transmitting region, i.e., the entire polishing pad can be the light-transmitting region, the polishing pad typically comprises a polishing pad body and at least one light-transmitting region, i.e., a portion that is not the light-transmitting region in addition to the at least one light-transmitting region.

The light-transmitting region can have a sufficient total light transmittance at one or more wavelengths in a range of 250 nm to 395 nm to be suitably observed and processed by an in situ end-point detection (EPD) system. For example, the total light transmittance of the light-transmitting region is about 25% or more, e.g., about 30% or more, about 35% or more, about 40% or more, about 45% or more, about 50% or more, about 55% or more, about 60% or more, about 65% or more, about 70% or more, about 75% or more, about 80% or more, about 85% or more, about 90% or more, about 95% or more, or about 100%, at one or more wavelengths in a range of 250 nm to 395 nm.

The total light transmittance of the light-transmitting region recited herein for the range of 250 nm to 395 nm is applicable to any one or more wavelengths within the range of 250 nm to 395 nm, e.g., 250 nm, 260 nm, 270 nm, 280 nm, 290 nm, 300 nm, 310 nm, 320 nm, 330 nm, 340 nm, 350 nm, 360 nm, 370 nm, 380 nm, 390 nm, or 395 nm, and ranges of wavelengths within the range of 250 nm to 395 nm. For example, the total light transmittance of the light-transmitting region as recited herein can be within the range of 250 nm or more, e.g., 255 nm or more, 260 nm or more, 265 nm or more, 270 nm or more, 275 nm or more, 280 nm or more, 285 nm or more, 290 nm or more, 295 nm or more, 300 nm or more, 305 nm or more, 310 nm or more, 315 nm or more, 320 nm or more, 325 nm or more, 330 nm or more, 335 nm or more, 340 nm or more, 345 nm or more, 350 nm or more, 355 nm or more, 360 nm or more, 365 nm or more, 370 nm or more, 375 nm or more, 380 nm or more, 385 nm or more, or 390 nm or more, provided that the upper limit of the range does not exceed 395 nm. Alternatively, or in addition, the total light transmittance of the light-transmitting region as recited herein can be within the range of 395 nm or less, e.g., 390 nm or less, 385 nm or less, 380 nm or less, 375 nm or less, 370 nm or less, 365 nm or less, 360 nm or less, 355 nm or less, 350 nm or less, 345 nm or less, 340 nm or less, 335 nm or less, 330 nm or less, 325 nm or less, 320 nm or less, 315 nm or less, 310 nm or less, 305 nm or less, 300 nm or less, 295 nm or less, 290 nm or less, 285 nm or less, 280 nm or less, 275 nm or less, 270 nm or less, 265 nm or less, 260 nm or less, or 255 or less, provided that the lower limit of the range is at least 250 nm. Thus, the total light transmittance of the light-transmitting region as recited herein with respect to the overall range of 250 nm to 395 nm can be within the wavelength range bounded by any two of the foregoing endpoints. For example, the total light transmittance of the light-transmitting region can be about 25% or more within the range of 360 nm to 380 nm, about 75% or more within the range of 300 nm to 355 nm, or about 100% within the range of 275 nm to 310 nm. Moreover, any of the individual wavelengths can be combined with any of the wavelength ranges when describing the total light transmittance of the light-transmitting region. In a preferred embodiment, the light-transmitting region has a total light transmittance about 25% or more within the range of 360 nm to 375 nm.

The light-transmitting region also can have a total light transmittance at one or more wavelengths in the range of 395 nm to 35,000 nm to be suitably observed and processed by an in situ end-point detection (EPD) system. For example, the total light transmittance of the light-transmitting region can be about 25% or more, e.g., about 30% or more, about 35% or more, about 40% or more, about 45% or more, about 50% or more, about 55% or more, about 60% or more, about 65% or more, about 70% or more, about 75% or more, about 80% or more, about 85% or more, about 90% or more, about 95% or more, or about 100% at one or more wavelengths within a range of 395 nm to 35,000 nm.

The total light transmittance of the light-transmitting region recited herein for the range of 395 nm to 35,000 nm is applicable to any one or more wavelengths within the range of 395 nm to 35,000 nm, e.g., 395 nm, 400 nm, 500 nm, 600 nm, 700 nm, 800 nm, 900 nm, 1,000 nm, 5,000 nm, 10,000 nm, or 35,000 nm, and ranges of wavelengths within the range of 395 nm to 35,000 nm. For example, the total light transmittance of the light-transmitting region as recited herein can be within the range of 395 nm or more, e.g., 400 nm or more, 425 nm or more, 450 nm or more, 475 nm or more, 500 nm or more, 525 nm or more, 550 nm or more, 575 nm or more, 600 nm or more, 625 nm or more, 650 nm or more, 675 nm or more, 700 nm or more, 725 nm or more, 750 nm or more, 775 nm or more, 800 nm or more, 825 nm or more, 850 nm or more, 875 nm or more, 800 nm or more, 825 nm or more, 850 nm or more, 875 nm or more, 900 nm or more, 925 nm or more, 950 nm or more, 975 nm or more, 1000 nm or more, 2000 nm or more, 3000 nm or more, 4000 nm or more, 5000 nm or more, 6000 nm or more, 7000 nm or more, 8000 nm or more, 9000 nm or more, 10,000 nm or more, 15,000 nm or more, 20,000 nm or more, 25,000 nm or more, or 30,000 nm or more, provided that the upper limit of the range does not exceed 35,000 nm. Alternatively, or in addition, the total light transmittance of the light-transmitting region as recited herein can be within the range of 35,000 nm or less, e.g., 30,000 nm or less, 25,000 nm or less, 20,000 nm or less, 15,000 nm or less, 10,000 nm or less, 9,000 nm or less, 8,000 nm or less, 7,000 nm or less, 6,000 nm or less, 5,000 nm or less, 4,000 nm or less, 3,000 nm or less, 2,000 nm or less, 1,000 nm or less, 975 nm or less, 950 nm or less, 925 nm or less, 900 nm or less, 875 nm or less, 850 nm or less, 825 nm or less, 800 nm or less, 775 nm or less, 750 nm or less, 725 nm or less, 700 nm or less, 675 nm or less, 650 nm or less, 625 nm or less, 600 nm or less, 575 nm or less, 550 nm or less, 525 nm or less, 500 nm or less, 475 nm or less, 450 nm or less, 425 nm or less, or 400 nm or less, provided that the lower limit of the range is at least 395 nm. Thus, the total light transmittance of the light-transmitting region as recited above with respect to the overall range of 395 nm to 35,000 nm can be within the wavelength range bounded by any two of the foregoing endpoints. For example, the total light transmittance of the light-transmitting region can be about 30% or more within the range of 495 nm to 10,000 nm, about 55% or more within the range of 800 nm to 2,000 nm, or about 70% or more within the range of 750 nm to 850 nm. In one embodiment, the light-transmitting region has a total light transmittance of about 25% or more at one or more wavelengths in a range of 400 nm to 800 nm. Moreover, any of the individual wavelengths can be combined with any of the wavelength ranges when describing the total light transmittance of the light-transmitting region.

Any of the total light transmittances recited herein for the light-transmitting region with respect to the wavelength ranges of 250 nm to 395 nm and 395 nm to 35,000 nm (and the individual wavelengths and wavelength ranges contained therein as described herein) can be combined in any suitable manner. For example, the light-transmitting region can have a total light transmittance of about 25% or more in a wavelength range of 260 nm to 315 nm and a total light transmittance of about 35% or more in a wavelength range of 370 nm to 395 nm. Alternatively, for example, the light-transmitting region can have a total light transmittance of about 25% or more in a wavelength range of 350 nm to 395 nm, a total light transmittance of about 40% or more in a wavelength range of 265 nm to 285 nm, and a total light transmittance of about 35% or more in a wavelength range of 295 nm to 335 nm. In another embodiment, the light-transmitting region can have a total light transmittance of about 25% or more in a wavelength range of 350 nm to 395 nm and a total light transmittance of about 25% or more in a wavelength range of 400 nm to 800 nm. Moreover, any of the individual wavelengths can be combined with any of the wavelength ranges when describing the total light transmittance of the light-transmitting region.

The total light transmittance of the light-transmitting region prior to ultraviolet light irradiation can differ from the total light transmittance of the light-transmitting region after ultraviolet light irradiation (sometimes referred to hereinafter as "total light transmittance difference") by about 30% or less at one or more wavelengths in a range of 250 nm to 395 nm and/or 395 nm to 35,000 nm (or any of the component individual wavelengths or ranges contained therein as recited herein), in which the ultraviolet light irradiation comprises irradiating the light-transmitting region with a 100 watt mercury vapor lamp at an intensity of at least about 1,000 $mW/cm^2$ for a duration of four minutes. For example, the total light transmittance difference can be about 30% or less, e.g., about 28% or less, about 26% or less, about 24% or less, about 22% or less, about 20% or less, about 18% or less, about 16% or less, about 14% or less, about 12% or less, about 10% or less, about 8% or less, about 6% or less, about 5% or less, about 4% or less, about 2% or less, or about 0% at one or more wavelengths in a range of 250 nm to 395 nm and/or 395 nm to 35,000 nm (or any of the component individual wavelengths and wavelength ranges contained therein as described herein).

The light-transmitting region has a total light transmittance of about 25% or more at one or more wavelengths in a range of 250 nm to 395 nm and/or 395 nm to 35,000 nm (or any of the individual component wavelengths or ranges as disclosed herein) after the light-transmitting region has been exposed to ultraviolet light irradiation, in which the ultraviolet light irradiation comprises irradiating the light-transmitting region with a 100 watt mercury vapor lamp at an intensity of at least about 1,000 $mW/cm^2$ for a duration of four minutes. For example, the total light transmittance of the light-transmitting region can be about 25% or more, e.g., about 30% or more, about 35% or more, about 40% or more, about 45% or more, about 50% or more, about 55% or more, about 60% or more, about 65% or more, about 70% or more, about 75% or more, about 80% or more, about 85% or more, about 90% or more, about 95% or more, or about 100% at one or more wavelengths in a range of 250 nm to 395 nm and/or 395 nm to 35,000 nm (or any of the component ranges as disclosed herein) after ultraviolet light irradiation under the conditions disclosed herein.

Irradiating the light-transmitting region with a 100 watt mercury vapor lamp at an intensity of at least about 1,000 $mW/cm^2$ for a duration of four minutes simulates about 5-10 million light flashes that typically would be used in a white light endpoint detection system (e.g., the FullVision system available from Advanced Materials) during a typical production run of polishing about 1000 wafers. The simulated light irradiation can be performed, e.g., using equipment available from UVEXS, which equipment provides high intensity ultraviolet and visible light energy. The 100 watt mercury vapor lamp used in the UVEXS system is capable of producing high intensity light (typically in excess of 1,000 mW/cm$^2$) in a wavelength range of 300 nm to 800 nm, with an ultraviolet energy peak at 365 nm.

The polymeric resin comprising the material that composes the light-transmitting region can be any polymeric resin suitable for use in chemical-mechanical polishing, provided that when the polymeric resin is included in the light-transmitting region, the light-transmitting region has the properties described herein. In one embodiment, the polymeric resin comprises at least one aliphatic polymer. Typically, the polymeric resin does not comprise conjugated double bonds and/or aromatic moieties. Desirably, the polymeric resin is a thermoplastic polymeric resin.

The at least one aliphatic polymer comprising the polymeric resin can be selected from the group consisting of polyurethanes, polycarbonate-based polyurethanes, polycarbonate-based diol or triol polyurethanes, linear aliphatic polycarbonate-based polyurethanes, branched aliphatic polycarbonate-based polyurethanes, cycloalkane-based aliphatic polyurethanes, polysiloxane-based polyurethanes, (alkyl)(alkyl)acrylates, (alkyl)(alkyl)acrylic acids, polyvinylidene fluorides, polyvinylidene difluorides, polychlorotrifluoroethylenes, polysiloxanes (e.g., silicones, etc.), polycarbonates, linear aliphatic polycarbonates (e.g., CALIBRE 5000 series available from STYRON), polymethylpentene-1, and combinations thereof.

The terms "(alkyl)(alkyl)acrylates" and "(alkyl)(alkyl) acrylic acids" as used herein mean that each of the "(alkyl)" portions is optional, i.e., may or may not be present in the polymer, and the "(alkyl)" portions may be the same or different. The "(alkyl)" portions typically comprises alkyl groups having 1 to 20 carbons. For example, suitable "(alkyl)(alkyl)acrylates" include methyl acrylate (i.e., the second "(alkyl)" is not present) and methyl methacrylate (in which both "(alkyl)" portions are present and are methyl groups). Suitable "(alkyl)" portions include methyl, ethyl, 2-ethylhexyl, propyl, butyl, pentyl, hexyl, heptyl, octyl, nonyl, decyl, etc., that can be combined in any suitable manner. Suitable "(alkyl)(alkyl)acrylates" include ethyl methacrylate and 2-ethylhexyl methacrylate. Suitable "(alkyl)(alkyl)acrylic acids" include butyl methacrylic acid and hexyl acrylic acid.

Desirably, the at least one aliphatic polymer is a thermoplastic polymer, a thermoset polymer, or any combination thereof (e.g., a thermoplastic polyurethane, a thermoplastic polyvinylidene difluoride, a thermoset polysiloxane, etc.).

The thermoplastic polymer can be selected from the group consisting of thermoplastic polyurethanes, polycarbonate-based thermoplastic polyurethanes, cycloalkane-based thermoplastic polyurethanes, polysiloxane-based thermoplastic polyurethanes, blends thereof, random copolymers thereof, and block copolymers thereof. In a preferred embodiment, the polymeric resin is an aliphatic polycarbonate-based thermoplastic polyurethane, such as CARBOTHANE™ TPU PC-3555D available from Lubrizol.

The aliphatic polymer can be a polyurethane comprising monomer units derived from at least one diol and at least one diisocyanate.

The at least one diol can be selected from the group consisting of a polyol, a polyol comprising cyclic aliphatic rings, a polycarbonate polyol, a polyakylene carbonate diol comprising 1 to 1000 repeat units (e.g., 200 to 800, or 400 to 600 repeat units), a polyethylene ether carbonate diol comprising 1 to 1000 repeat units (e.g., 200 to 800, or 400 to 600 repeat units), an alkyl diol such as 1,12-dodecanediol, 1,11-undecanediol, 1,10-decanediol, 1,9-nonanediol, 1,8-octanediol, 1,7-heptanediol, 1,6-hexanediol, 1,5-pentanediol, 1,4-butanediol, 1,3-propanediol, and 1,2-ethanediol, and combinations thereof. The polyaklyene carbonate diol can comprise any suitable alkylene group, such as methylene, ethylene, propylene, butylene, pentylene, hexylene (i.e., hexamethylene), etc. In a preferred embodiment, the polyalkylene carbonate diol is polyhexamethylene carbonate diol.

Diols are sometimes termed "chain extenders" in the art. The types of diols listed hereinabove are also known as "$\alpha,\omega$ diols," since the diols contain hydroxyl groups at the $\alpha$ and $\omega$ positions of the alkane chain. The aliphatic polymer in some embodiments contains two, three, four, five, or six diols in combination, in which the diols in combination can be the same or different diols. In a preferred embodiment, the aliphatic polymer comprises two different diols, such as a polyhexamethylene carbonate diol comprising 1 to 1000 repeat units and 1,4-butanediol.

Triols also can be suitably used to form polyurethanes suitable for use in the material comprising the light-transmitting region of the invention. Suitable triols include trimethylolpropane, glycerin, triethanolamine, 1,2,6-hexanetriol, and combinations thereof.

The polyol (including diols containing repeat units) can have any suitable molecular weight. For example, the molecular weight of the polyol can be about 400 g/mol or more, e.g., about 500 g/mol or more, about 700 g/mol or more, about 900 g/mol or more, about 1000 g/mol or more, about 1200 g/mol or more, about 1400 g/mol or more, about 1600 g/mol or more, about 1800 g/mol or more, about 2000 g/mol or more, about 2200 g/mol or more, about 2400 g/mol or more, about 2600 g/mol or more, about 2800 g/mol or more, about 3000 g/mol or more, about 3200 g/mol or more, about 3400 g/mol or more, about 3600 g/mol or more, about 3800 g/mol or more, about 4000 g/mol or more, about 4200 g/mol or more, about 4400 g/mol or more, about 4600 g/mol or more, about 4800 g/mol or more, about 5000 g/mol or more, or about 5200 g/mol or more. Alternatively, or in addition, the molecular weight of the polyol can be about 5200 g/mol or less, e.g., about 5000 g/mol or less, about 4800 g/mol or less, about 4600 g/mol or less, about 4400 g/mol or less, about 4200 g/mol or less, about 4000 g/mol or less, about 3800 g/mol or less, about 3600 g/mol or less, about 3400 g/mol or less, about 3200 g/mol or less, about 3000 g/mol or less, about 2800 g/mol or less, about 2600 g/mol or less, about 2400 g/mol or less, about 2200 g/mol or less, about 2000 g/mol or less, about 1800 g/mol or less, about 1600 g/mol or less, about 1400 g/mol or less, about 1200 g/mol or less, about 1000 g/mol or less, about 900 g/mol or less, about 700 g/mol or less, or about 500 g/mol or less. Thus, the molecular weight of the polyol can be bounded by any two of the endpoints recited hereinabove. For example, the molecular weight of the polyol can be about 500 g/mol to about 5000 g/mol, about 1200 g/mol to about 4600 g/mol, or about 700 g/mol to about 3400 g/mol.

Amine-containing difunctional compounds, such as diamines, amine-containing di- or polyols, and/or difunctional alkanolamines, also can be employed in a reaction with diisocyanates in order to form an aliphatic polymer suitable for use in the invention. The amine-containing difunctional compounds can be employed in place of, or in addition to, diols in the reaction with diisocyanates. Any amine-containing difunctional compound can be employed, provided that the difunctional compound has an aliphatic backbone. Suitable amine-containing difunctional compounds include 1,2-diamino ethane, 1,3-diamino propane, 1,4-diamino butane, 1,5-diamino pentane, 1,6-diamino hexane, 1,7-diamino heptane, 1,8-diamino octane, 1,9-diamino nonane, 1,10-diamino decane, 2-aminoethanol, 3-aminopropanol, 4-aminobutanol, 5-aminopentanol, 6-aminohexanol, 7-aminoheptanol, 8-aminooctanol, 9-aminononanol, 10-aminodecanol, and combinations thereof.

The at least one diisocyanate can be selected from any aliphatic diisocyanate, provided that, when the diisocyanate is incorporated into a polymeric resin, the polymeric resin has the properties described herein. Chemical structures of diisocyanates that may be suitably used in the invention are depicted below.

A

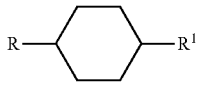

B

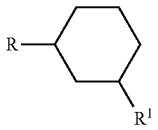

C

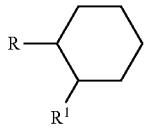

D

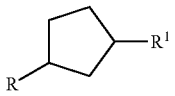

E

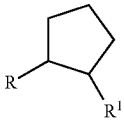

F

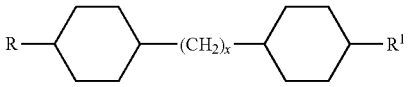

G

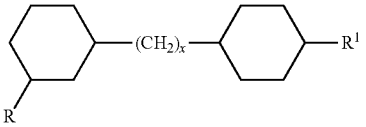

H

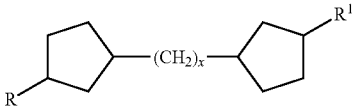

I

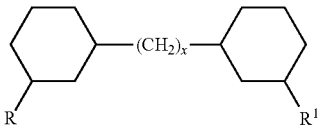

-continued

J

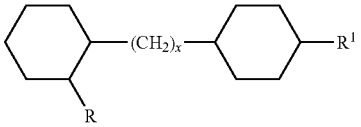

K

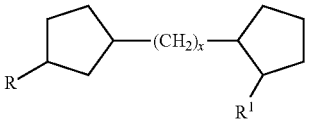

L

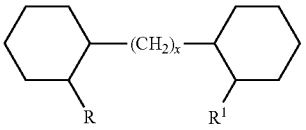

M

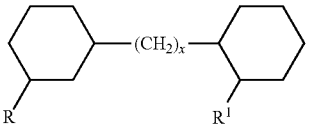

N

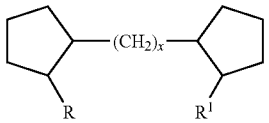

O

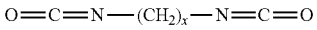

R, R$^1$ = 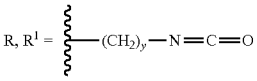

In the diisocyanate chemical structures above, the subscripts x and y can be the same or different, and can be 0, 1, 2, 3, 4, 5, 6, 7, 8, 9, 10, 11, 12, 13, 14, 15, 16, 17, 18, 19, or 20. The groups R and R$^1$ can be the same or different.

In a preferred embodiment, the diisocyanate is dicyclohexylmethane 4,4'-diisocyanate having the structure depicted below. Dicyclohexylmethane 4,4'-diisocyanate corresponds to Structure F above, in which x=1, y=0, and R and R$^1$ are the same.

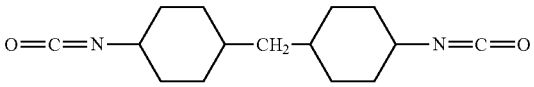

Dicyclohexylmethane 4,4′-diisocyanate

In a preferred embodiment, the aliphatic polymer comprises two diols, such as 1,4-butanediol and a polyhexamethylene carbonate diol (comprising 1 to 1000 repeat units and having a molecular weight of about 500 g/mol to about 5000 g/mol), and one diisocyanate, such as dicyclohexylmethane 4,4'-diisocyanate. The structure of an aliphatic polymer comprising these units is depicted below.

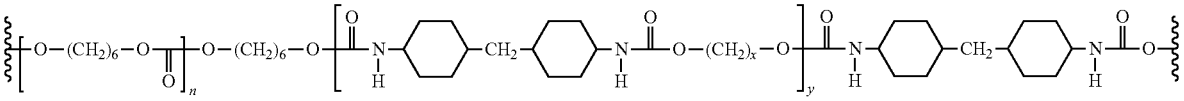

polycarbonate-based thermoplastic polyurethane

In the above structure, the number of repeat units of polyhexamethylene carbonate diol is represented by n, which feature is discussed elsewhere herein. In the situation where 1,4-butanediol is employed, the subscript x is equal to 4. The subscript y represents the number of repeat units obtained from reacting an α,ω diol, such as 1,4-butanediol, with a diisocyanate, such as dicyclohexylmethane 4,4'-diisocyanate. The number of repeat units represented by n and y must be balanced depending on the desired rheological properties of the resulting polymer (e.g., resin melt index or melt flow rate, resin melt viscosity, etc.) to ensure that the polymer can be suitably molded (e.g., extruded or injection molded), as discussed in more detail herein. The number of repeat units represented by n and y also determines the molecular weight of the polymer, which is also discussed herein. Typically, however, the number of repeat units represented by y will be in a range of 1 to 1000 repeat units (e.g., 200 to 800, or 400 to 600 repeat units).

Polymers that are not preferred (sometimes referred to hereinafter as "non-preferred polymers") for use in the material comprising the light-transmitting region(s) include non-aliphatic polymers, such as poly(ethylene terephthalate), polyarylenes, polystyrenes, and/or any aliphatic polymer that has a number of light-absorbing moieties (e.g., aromatic groups and/or conjugated double bonds) which typically prevent the light-transmitting region from having the properties described herein. For example, polymers, such as thermoplastic or thermoset polyurethanes or polyureas, which comprise alkylene diphenyl diisocyanates (such as methylene diphenyl diisocyanates, e.g., 4,4'-methylenediphenyl diisocyanate, 2,4'-methylenediphenyl diisocyanate, and 2,2'-methylenediphenyl diisocyanate) or toluene diisocyanates (such as 2,3'-toluene diisocyanate, 2,4'-toluene diisocyanate, 2,5'-toluene diisocyanate, and 2,6'-toluene diisocyanate), which may be cross-linked or may not be cross-linked, typically are not preferred for use in the material comprising the light-transmitting region(s) of the present invention. These non-preferred polymers typically absorb light too strongly in the 250 nm to 395 nm range, and thus are unsuitable for use with a white light in situ endpoint detection system. Examples of non-preferred conventional thermoplastic polyurethane polymers are depicted below.

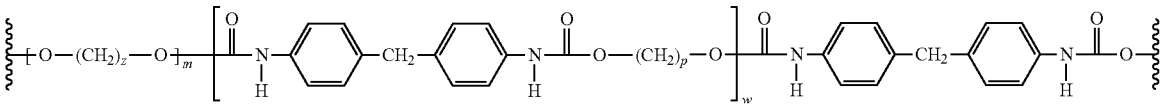

methylenediphenyl diisocyanate-based thermoplastic polyurethane

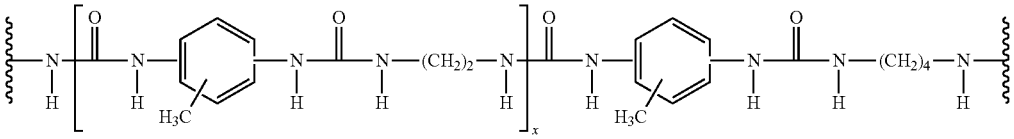

toluene diisocyanate-based thermosetting polyurea

In preferred embodiments, these non-preferred polymers are not included in the material comprising the light transmitting region. In some embodiments, however, any of the non-preferred polymers can be included in the material comprising the light-transmitting region, provided that the light-transmitting region has the properties described herein. Including one or more non-preferred polymers in the material comprising the light-transmitting region may be desired, for example, when adjusting the structural (e.g., hardness, porosity, etc.) and/or light-transmitting properties of the light-transmitting region.

The non-preferred polymers, or the monomers comprising the non-preferred polymers, can be hydrogenated using techniques well-known in the art in order to convert the aromatic rings and/or conjugated double bonds into aliphatic structures. Such hydrogenation significantly reduces or eliminates the total light absorption of these compounds, such that, when these hydrogenated compounds are incorporated into the light-transmitting region of a polishing pad, the light-transmitting region can have the properties disclosed herein.

When a non-preferred polymer is included in the material comprising the light-transmitting region, the non-preferred polymer is typically present in an amount of about 10 wt. % or less, based on the weight of the light-transmitting region. For example, the material can comprise about 10 wt. % or less, e.g., about 9.5 wt. % or less, about 9 wt. % or less, about 8.5 wt. % or less, about 8 wt. % or less, about 7.5 wt. % or less, about 7 wt. % or less, about 6.5 wt. % or less, about 6 wt. % or less, about 5.5 wt. % or less, about 5 wt. % or less, about 4.5 wt. % or less, about 4 wt. % or less, about 3.5 wt. % or less, about 3 wt. % or less, about 2.5 wt. % or less, about 2 wt. % or less, about 1.5 wt. % or less, about 1 wt. % or less, or about 0.5 wt. % or less. Alternatively, or in addition, the material can comprise about 0.5 wt. % or more, e.g., about 1 wt. % or more, about 1.5 wt. % or more, about 2 wt. % or more, about 2.5 wt. % or more, about 3 wt. % or more, about 3.5 wt. % or more, about 4 wt. % or more, about 4.5 wt. % or more, about 5 wt. % or more, about 5.5 wt. % or more, about 6 wt. % or more, about 6.5 wt. % or more, about 7 wt. % or more, about 7.5 wt. % or more, about 8 wt. % or more, about 8.5 wt. % or more, about 9 wt. % or more, or about 9.5 wt. % or more. Thus, the amount of non-preferred polymer in the material comprising the light-transmitting region can be bounded by any two of the foregoing endpoints. For example, the material can comprise about 1.5 wt. % to about 3 wt. %, about 2 wt. % to about 5 wt. %, or about 8 wt. % to about 8.5 wt. %. In a preferred embodiment, the material comprises 0 wt. % of a non-preferred polymer.

Not all polymers or polymeric resins that are substantially free of light-absorbing moieties (e.g., aromatic groups and/or conjugated double bonds) meet the light transmission properties recited herein. For example, some polycaprolactam-based aliphatic thermoplastic polyurethanes (see chemical structure depicted below), which are very structurally similar to polycarbonate-based aliphatic thermoplastic polyurethanes, do not have a total light transmittance of about 25% or more within the range of 250 nm to 395 nm (see the Examples herein). As a result, only certain types of polymers or polymeric resins can suitably be used in the invention.

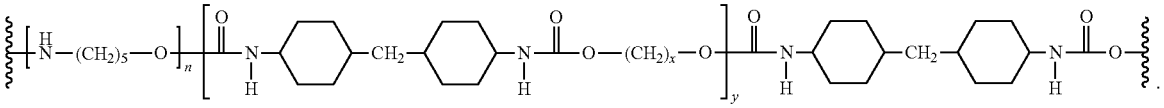

polycaprolactam-based thermoplastic polyurethane

The at least one light-absorbing compound included in the material comprising the light-transmitting region can be any suitable light-absorbing compound, provided that, when the light-absorbing compound is included in the material comprising the light-transmitting region, the light-transmitting region has the properties described herein. A light absorbing compound is included in the material in order to increase the stability of the material to white light (e.g., ultraviolet and visible light). For example, a light absorbing compound helps prevent the polymeric resin from yellowing and/or becoming brittle upon exposure to white light (e.g., ultraviolet and visible light).

In one embodiment, suitable light-absorbing compounds that can be employed in the material comprising the light-transmitting region meet the following condition: a solution of a light-absorbing compound at a concentration of 10 mg/L has an absorbance of 0.5 or less in a range of 330 nm to 400 nm. For example, the absorbance of a solution of a light-absorbing compound can be 0.5 or less, e.g., 0.45 or less, 0.4 or less, 0.35 or less, 0.3 or less, 0.25 or less, 0.2 or less, 0.15 or less, 0.1 or less, or 0.05 or less, in a range of 330 nm to 400 nm. Alternatively, or in addition, the absorbance of a solution of a light-absorbing compound can be 0.05 or more, e.g., 0.1 or more, 0.15 or more, 0.2 or more, 0.25 or more, 0.3 or more, 0.35 or more, 0.4 or more, or 0.45 or more, in a range of 330 nm to 400 nm, provided that the absorbance of the solution does not exceed 0.5. Thus, the absorbance of a solution of a light-absorbing compound at a concentration of 10 mg/L can be bounded by any two of the foregoing endpoints. For example, the absorbance can be 0.05 to 0.4, 0.3 to 0.35, or 0.25 to 0.45 in a range of 330 nm to 400 nm. In one embodiment, the absorbance is zero in a range of 330 nm to 400 nm.

The absorbance recited herein for a solution of a light-absorbing compound at a concentration of 10 mg/L is applicable to any one or more wavelengths within the range of 330 nm to 400 nm, e.g., 330 nm, 340 nm, 350 nm, 360 nm, 370 nm, 380 nm, 390 nm, or 400 nm, and ranges of wavelengths within the range of 330 nm to 400 nm. For example, the absorbance of a solution of a light-absorbing compound at a concentration of 10 mg/L as recited herein can be within the range of 330 nm or more, e.g., 335 nm or more, 340 nm or more, 345 nm or more, 350 nm or more, 355 nm or more, 360 nm or more, 365 nm or more, 370 nm or more, 375 nm or more, 380 nm or more, 385 nm or more, 390 nm or more, or 395 nm or more, provided that the upper limit of the range does not exceed 400 nm. Alternatively, or in addition, the absorbance of a solution of a light-absorbing compound at a concentration of 10 mg/L as recited herein can be within the range of 400 nm or less, e.g., 395 nm or less, 390 nm or less, 385 nm or less, 380 nm or less, 375 nm or less, 370 nm or less, 365 nm or less, 360 nm or less, 355 nm or less, 350 nm or less, 345 nm or less, 340 nm or less, or 335 nm or less, provided that the lower limit of the range is at least 330 nm. Thus, the absorbance of a solution of a light-absorbing compound at a concentration of 10 mg/L as recited herein can be within a range bounded by any two of the foregoing endpoints. For example, the absorbance can be 0.1 to 0.45 within a range of 355 nm to 395 nm, 0.05 to 0.35 within a range of 360 nm to 380 nm, or 0.2 to 0.25 within a range of 370 nm to 400 nm. In one embodiment, the absorbance of a solution of the at least one light-absorbing compound at a concentration of 10 mg/L is zero in a range of 350 nm to 400 nm. Moreover, any of the individual wavelengths can be combined with any of the wavelength ranges when describing the absorbance of a solution of a light-absorbing compound in toluene at a concentration of 10 mg/L.

Suitable light-absorbing compounds that can be employed in the material comprising the light-transmitting region may additionally, or alternatively, meet the following condition: a solution of the at least one light-absorbing compound does not have a maximum light absorption located in a range of 335 nm to 400 nm. As used herein, the term "maximum light absorption" can mean a local maximum or a global maximum depending on the location and degree of absorbance in relation to the desired properties of the light-transmitting region as described herein, but typically the term refers to a global maximum. A light-absorbing compound typically does not have a maximum light absorption located in a range of 335 nm or more, e.g., 340 nm or more, 345 nm or more, 350 nm or more, 355 nm or more, 360 nm or more, 365 nm or more, 370 nm or more, 375 nm or more, 380 nm or more, 385 nm or more, 390 nm or more, or 395 nm or more, provided that the upper limit of the range does not exceed 400 nm. Alternatively, or in addition, a light-absorbing compound typically does not have a maximum light absorption located in a range of 400 nm or less, e.g., 395 nm or less, 390 nm or less, 385 nm or less, 380 nm or less, 375 nm or less, 370 nm or less, 365 nm or less, 360 nm or less, 355 nm or less, 350 nm or less, 345 nm or less, or 340 nm or less, provided that the lower limit of the range is at least 335 nm. Thus, a solution of the at least one light-absorbing compound typically does not have a maximum absorption located in a wavelength range bounded by any two of the foregoing endpoints. For example, a solution of a light-absorbing compound typically does not have a maximum absorption located in a range of 335 nm to 385 nm, 350 nm to 400 nm, or 340 nm to 375 nm.

The absorptions of light-absorbing compounds can be measured in a variety of solvents, including methanol, toluene, and chloroform, respectively. The absorbance and/or location of the absorption maximum of a 10 mg/L solution of a light-absorbing compound, without reference to the specific solvent that the ultraviolet-visible spectrum is recorded in, is a good predictor of whether the light-absorbing compound is suitable for use in the light-transmitting region of the invention.

In one embodiment, the material comprising the light-transmitting region contains one light-absorbing compound. In another embodiment, the material comprising the light-transmitting region contains more than one light-absorbing compound, for example, a combination of two, three, four, five, or six light-absorbing compounds, which can be the same or different. Any suitable light-absorbing compound alone or in combination can be employed in the present invention, provided that, when the one or more light-absorbing compounds are employed in the material comprising the light-transmitting region, the light-transmitting region possesses the properties described herein.

Suitable light-absorbing compounds can be selected from the group consisting of pentaerythritol tetrakis(2-cyano-3,3-diphenylacrylate) (e.g., UVINUL™ 3030), 2-ethylhexyl-p-methoxycinnamate (e.g., UVINUL™ 3088), ethyl-2-cyano-3,3'-diphenylacrylate (e.g., UVINUL™ 3035), octyl-p-methoxycinnamate, 4-aminobenzoate-trialkylorthoformate (e.g., BITTUVEN™ 312), ethyl(4-ethoxycarbonylphenyl)-N-methyl-N-phenylformamidine, N,N-bis-(4-ethoxycarbonylphenyl)-N-methylformamidine, N2-(4-ethoxycarbonylphenyl)-N1-methyl-N1-phenylformamidine (e.g., CINABSORB™), 2-hydroxy-4-n-octoxybenzophenone (e.g., CYASORB™ UV-531), 2-propenoic acid-3-(4-methoxyphenyl)-2-ethylhexyl ester (e.g., EUSOLEX™ 2292), ethyl-2-cyano-3,3-diphenylacrylate, 2-ethylhexyl-3,3-diphenylacrylate, ethyl-3,3-bis(4-methoxyphenyl)acrylate, 2-ethylhexyl-2-cyano-3,3-diphenylacrylate, homomethyl salicylate, 2-phenyl-benzimidazole-5-sulphonic acid, triethyl salicylate, octyldimethyl 4-aminobenzoic acid (e.g., ESCALOL™ 507), 4-methylbenzilidene camphor (e.g., PARSOL™ 5000), di-2'-ethylhexyl-3,5-dimethoxy-4-hydroxy benzylidene malonate, 2-(4,6-Bis-(2,4-dimethylphenyl)-1,3,5-triazin-2-yl)-5-(octyloxy)-phenol (e.g., CYASORB™ UV-1164), cyanoacrylates, triazines, bis-methines, camphor derivatives, and combinations thereof.

Figure 1B:
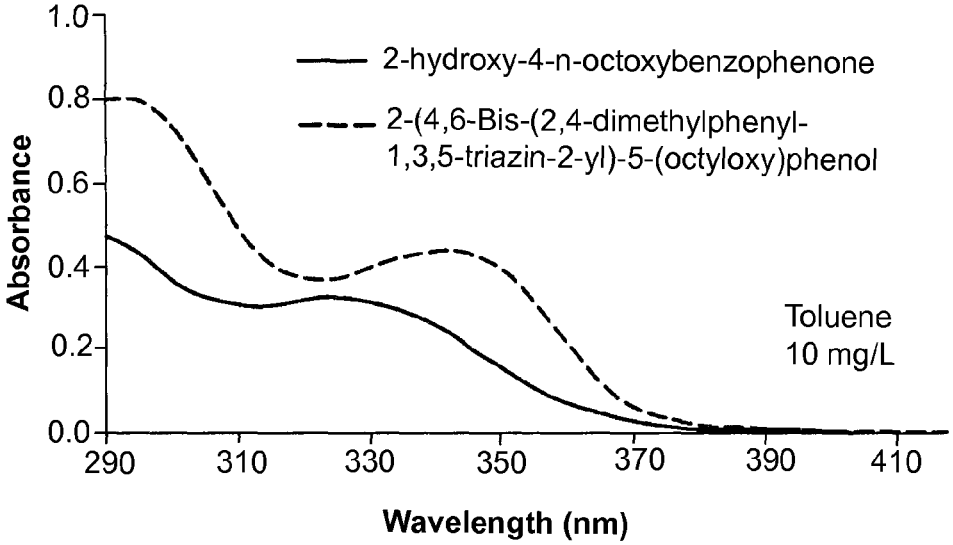

FIG. 1A and FIG. 1B depict the ultraviolet-visible spectra of light-absorbing compounds that are suitable for use in the material comprising the light-transmitting region of the invention. The data shown in FIG. 1A and FIG. 1B were acquired from the manufacturers of the light-absorbing compounds. FIG. 1A is an ultraviolet-visible spectrum of 2-ethylhexyl-p-methoxycinnamate (e.g., UVINUL™ 3088) in methanol at a concentration of 10 mg/L (1 cm path length), which reveals an absorbance of 0.42 or less in the range of at least 250 nm to 350 nm and a maximum light absorption located at about 310 nm. FIG. 1B depicts overlaid ultraviolet-visible spectra of separate solutions of 2-hydroxy-4-n-octoxybenzophenone (e.g., CYASORB™ UV-531) and 2-(4,6-bis-(2,4-dimethylphenyl)-1,3,5-triazin-2-yl)-5-(octyloxy)-phenol (e.g., CYASORB™ UV-1164) in toluene at a concentration of 10 mg/L. As shown in FIG. 1B, CYASORB™ UV-531 has an absorbance of 0.5 or less in a range of 290 nm to 410 nm and a maximum light absorption located at about 325 nm, and CYASORB™ UV-1164 has an absorbance of 0.5 or less in a range of 310 nm to 410 nm and a maximum light absorption located at about 340 nm. The spectrum of UVINUL™ 3088 in FIG. 1B, and the overlaid spectra of CYASORB™ UV-531 and CYASORB™ UV-1164 in FIG. 1B, reveal that all three of these light-absorbing compounds can be suitably used in the material comprising the light-transmitting region of the invention.

The one or more light-absorbing compounds can be employed in the material comprising the light-transmitting region in any suitable amount. The amount of light-absorbing compound included in the light-transmitting region of the invention depends, in part, on the location of the maximum absorbance and/or molar absorptivity of the light-absorbing compound. For example, the one or more light-absorbing compounds can be incorporated into the material comprising the light-transmitting region in an amount of about 0.05% to about 20% by weight based on the weight of the light-transmitting region. In particular, the one or more light-absorbing compounds can be incorporated into the material comprising the light-transmitting region in an amount of about 0.05% or more, e.g., about 0.1% or more, about 0.15% or more, about 0.2% or more, about 0.25% or more, about 0.3% or more, about 0.35% or more, about 0.4% or more, about 0.45% or more, about 0.5% or more, about 0.55% or more, about 0.6% or more, about 0.65% or more, about 0.7% or more, about 0.75% or more, about 0.8% or more, about 0.85% or more, about 0.9% or more, about 0.95% or more, about 1.1% or more, about 1.2% or more, about 1.3% or more, about 1.4% or more, about 1.5% or more, about 1.6% or more, about 1.7% or more, about 1.8% or more, about 1.9% or more, about 2% or more, about 2.5% or more, about 3% or more, about 3.5% or more, about 4% or more, about 4.5% or more, about 5% or more, about 5.5% or more, about 6% or more, about 6.5% or more, about 7% or more, about 7.5% or more, about 8% or more, about 8.5% or more, about 9% or more, about 9.5% or more, about 10% or more, about 11% or more, about 12% or more, about 13% or more, about 14% or more, about 15% or more, about 16% or more, about 17% or more, about 18% or more, or about 19% or more, by weight based on the weight of the light-transmitting region. Alternatively, or in addition, the one or more light-absorbing compounds can be incorporated into the material comprising the light-transmitting region in an amount of about 20% or less, e.g., about 19% or less, about 18% or less, about 17% or less, about 16% or less, about 15% or less, about 14% or less, about 13% or less, about 12% or less, about 11% or less, about 10% or less, about 9.5% or less, about 9% or less, about 8.5% or less, about 8% or less, about 7.5% or less, about 7% or less, about 6.5% or less, about 6% or less, about 5.5% or less, about 5% or less, about 4.5% or less, about 4% or less, about 3.5% or less, about 3% or less, about 2.5% or less, about 2% or less, about 1.9% or less, about 1.8% or less, about 1.7% or less, about 1.6% or less, about 1.5% or less, about 1.4% or less, about 1.3% or less, about 1.2% or less, about 1.1% or less, about 1% or less, about 0.95% or less, about 0.9% or less, about 0.85% or less, about 0.8% or less, about 0.75% or less, about 0.7% or less, about 0.65% or less, about 0.6% or less, about 0.55% or less, about 0.5% or less, about 0.45% or less, about 0.4% or less, about 0.35% or less, about 0.3% or less, about 0.25% or less, about 0.2% or less, about 0.15% or less, or about 0.1% or less, by weight based on the weight of the light-transmitting region. Thus, the one or more light-absorbing compounds can be incorporated into the material comprising the light-transmitting region in amounts bounded by any two of the foregoing endpoints. For example, the one or more light-absorbing compounds can be incorporated into the material comprising the light-transmitting region in amounts of about 0.05% to about 1.5%, about 1% to about 5%, or about 4.5% to about 11% by weight based on the weight of the light-transmitting region. When more than one light-absorbing compound is employed, the foregoing recited amounts refer to the total amount of light-absorbing compound present in the material comprising light-transmitting region.

Not all light-absorbing compounds can be satisfactorily employed in the light-transmitting region of the invention. Unsuitable light-absorbing compounds typically will significantly absorb light and/or have a maximum absorption located in a wavelength range that makes it difficult for polishing pads containing these unsuitable compounds to be suitably used with white light endpoint detection systems. Examples of light-absorbing compounds that are not suitable for use with the invention include hindered amine light stabilizers (i.e., HALS), 2-(2-hydroxy-5-methylphenyl)benzotriazole (e.g., TINUVIN™ P), 2-(2H-benzotriazol-2-yl)-4,6-ditertpentylphenol (e.g., TINUVIN™ 328), etc. In a preferred embodiment, the material comprising the light-transmitting region of the invention does not contain any of these unsuitable light-absorbing compounds. Two types of light-absorbing compounds that are not suitable for use in the material of the light-transmitting region of the invention are depicted below and include certain types of benzotriazoles and benzophenones.

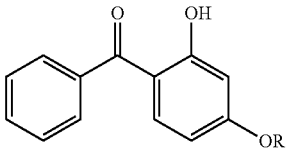

Benzophenone

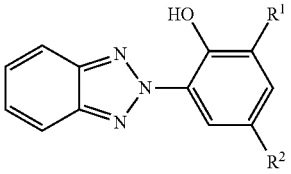

Benzotriazole

In these benzophenone and benzotriazole structures, the substituent R is typically hydrogen, an alkyl group (e.g., methyl, ethyl, propyl, butyl, and pentyl), an ester, etc. The substituents $R^1$ and $R^2$ can be the same or different and typically include hydrogen, an alkyl group (e.g., methyl, ethyl, propyl, isopropyl, n-butyl, tert-butyl, isobutyl, sec-butyl, n-pentyl, tert-pentyl, sec-pentyl, etc.), a hydroxyl group, a halogen (e.g., fluoro, chloro, bromo, iodo, etc.), or an ester.

Figure 2:
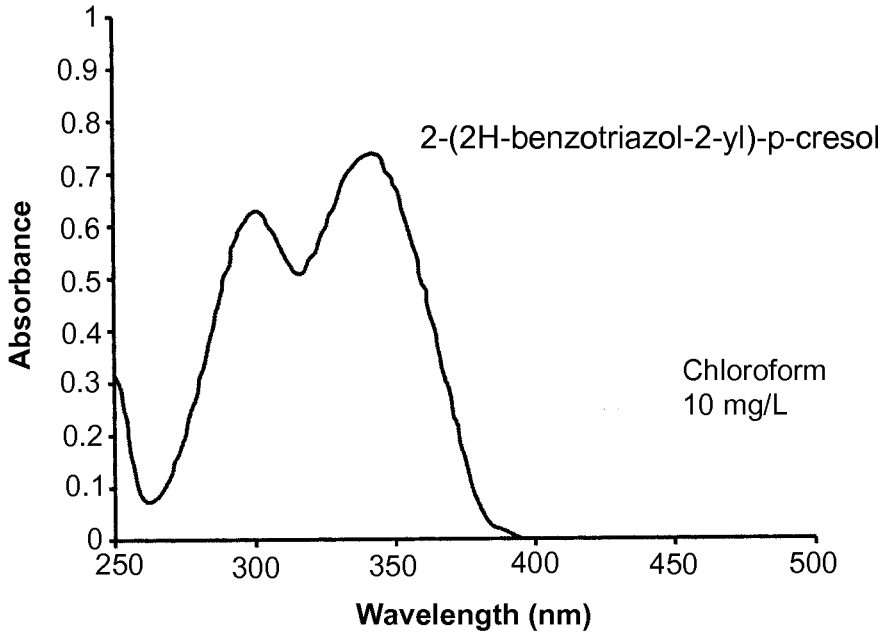
FIG. 2 is depicts an ultraviolet-visible spectrum of a light-absorbing compound that is not suitable for use in the material comprising the light-transmitting region of the invention.

FIG. 2 depicts the ultraviolet-visible spectrum of a light-absorbing compound that is not suitable for use in the material comprising the light-transmitting region of the invention. The data shown in FIG. 2 was obtained from the manufacturer of the light-absorbing compound. FIG. 2 is an ultraviolet-visible spectrum of 2-(2-hydroxy-5-methylphenyl)benzotriazole (e.g., TINUVIN™ P) in chloroform at a concentration of 10 mg/L, which reveals this light-absorbing compound to have an absorbance of 0.5 or less in a range of 250 nm to 288 nm and 360 nm to 500 nm and two maximum light absorptions of similar intensity located at 301 and 341 nm. The spectrum in FIG. 2 reveals that this light-absorbing compound is unsuitable for use in the material comprising the light-transmitting region of the invention.

The light-transmitting region is discolored about 45% or less at one or more wavelengths in a range of 395 nm to 800 nm upon ultraviolet light irradiation, as measured according to ASTM D1148-95, hereby incorporated by reference in its entirety. For example, the light-transmitting region is discolored about 40% or less, about 35% or less, about 30% or less, about 25% or less, about 20% or less, about 15% or less, about 10% or less, about 5% or less, or about 0% at one or more wavelengths in a range of 395 nm to 800 nm upon ultraviolet light irradiation, as measured according to ASTM D1148-95.

The degree of discoloration (%) of the light-transmitting region recited herein for the range of 395 nm to 800 nm as measured by ASTM D1148-95 is applicable to any one or more wavelengths within the range of 395 nm to 800 nm, including individual wavelengths (e.g., 395 nm, 400 nm, 410 nm, 420 nm, 430 nm, 440 nm, 450 nm, 460 nm, 470 nm, 480 nm, 490 nm, 500 nm, 520 nm, 540 nm, 560 nm, 580 nm, 600 nm, 620 nm, 640 nm, 660 nm, 680 nm, 700 nm, 720 nm, 740 nm, 760 nm, 780 nm, or 800 nm) and ranges of wavelengths within the range of 395 nm to 800 nm. For example, the degree of discoloration (%) of the light-transmitting region as recited herein can be within the range of 395 nm or more, e.g., 400 nm or more, 410 nm or more, 420 nm or more, 430 nm or more, 440 nm or more, 450 nm or more, 460 nm or more, 470 nm or more, 480 nm or more, 490 nm or more, 500 nm or more, 510 nm or more, 520 nm or more, 530 nm or more, 540 nm or more, 550 nm or more, 560 nm or more, 570 nm or more, 580 nm or more, 590 nm or more, 600 nm or more, 610 nm or more, 620 nm or more, 630 nm or more, 640 nm or more, 650 nm or more, 660 nm or more, 670 nm or more, 680 nm or more, 690 nm or more, 700 nm or more, 710 nm or more, 720 nm or more, 730 nm or more, 740 nm or more, 750 nm or more, 760 nm or more, 770 nm or more, 780 nm or more, or 790 nm or more. Alternatively, or in addition, the degree of discoloration (%) of the light-transmitting region as recited herein can be within the range of 800 nm or less, e.g., 790 nm or less, 780 nm or less, 770 nm or less, 760 nm or less, 750 nm or less, 740 nm or less, 730 nm or less, 720 mu or less, 710 nm or less, 700 nm or less, 690 nm or less, 680 nm or less, 670 nm or less, 660 nm or less, 650 nm or less, 640 nm or less, 630 nm or less, 620 nm or less, 610 nm or less, 600 nm or less, 590 nm or less, 580 nm or less, 570 nm or less, 560 nm or less, 550 nm or less, 540 nm or less, 530 nm or less, 520 nm or less, 510 nm or less, 500 nm or less, 490 nm or less, 480 nm or less, 470 nm or less, 460 nm or less, 450 nm or less, 440 nm or less, 430 nm or less, 420 nm or less, 410 nm or less, or 400 nm or less. Thus, the degree of discoloration (in %) of the light-transmitting region as recited herein can be bounded by any two of the foregoing endpoints. For example, the degree of discoloration of the light-transmitting region can be about 45% or less in a range of 395 nm to 800 nm, about 25% or less in a range of 410 nm to 480 nm, or about 40% or less in a range of 450 nm to 550 nm. Moreover, any of the individual wavelengths can be combined with any of the wavelength ranges when describing the degree of discoloration of the light-transmitting region.

The polishing pad body typically is porous and has a first void volume (i.e., porosity). The first void volume typically is non-zero and can be any suitable non-zero void volume. For example, the first void volume can be about 0.1% or more, e.g., about 0.2% or more, about 0.3% or more, about 0.4% or more, about 0.5% or more, about 0.6% or more, about 0.7% or more, about 0.8% or more, about 0.9% or more, about 1% or more, about 2% or more, about 3% or more, about 4% or more, about 5% or more, about 6% or more, about 7% or more, about 8% or more, about 9% or more, about 10% or more, about 15% or more, about 20% or more, about 25% or more, about 30% or more, about 35% or more, about 40% or more, about 45% or more, about 50% or more, about 55% or more, about 60% or more, about 65% or more, about 70% or more, or about 75% or more. Alternatively, or in addition, the first void volume can be about 80% or less, e.g., about 75% or less, about 70% or less, about 65% or less, about 60% or less, about 55% or less, about 50% or less, about 45% or less, about 40% or less, about 35% or less, about 30% or less, about 25% or less, about 20% or less, about 15% or less, about 10% or less, about 9% or less, about 8% or less, about 7% or less, about 6% or less, about 5% or less, about 4% or less, about 3% or less, about 2% or less, about 1% or less, about 0.9% or less, about 0.8% or less, about 0.7% or less, about 0.6% or less, about 0.5% or less, about 0.4% or less, about 0.3% or less, or about 0.2% or less. Thus, the first void volume can be bounded by any two of the foregoing endpoints. For example, the first void volume can be about 0.1% to about 80%, about 20% to about 50%, or about 65% to about 70%.

The polishing pad body can comprise pores of any suitable average pore size. As used herein, the term "average pore size" refers to the average pore diameter. For example, the pores of the polishing pad body can have an average pore size of about 1000 μm or less, e.g., about 900 μm or less, about 800 μm or less, about 700 μm or less, about 600 μm or less, about 500 μm or less, about 400 μm or less, about 300 μm or less, about 200 μm or less, about 190 μm or less, about 180 μm or less, about 170 μm or less, about 160 μm or less, about 150 μm or less, about 140 μm or less, about 130 μm or less, about 120 μm or less, about 110 μm or less, about 100 μm or less, about 90 μm or less, about 80 μm or less, about 70 μm or less, about 60 μm or less, about 50 μm or less, about 40 μm or less, about 30 μm or less, about 20 μm or less, about 10 μm or less, or about 5 μm or less. Alternatively, or in addition, the pores of the polishing pad body can have an average pore size of about 1 μm or more, e.g., about 5 μm or more, about 10 μm or more, about 20 μm or more, about 30 μm or more, about 40 μm or more, about 50 μm or more, about 60 μm or more, about 70 μm or more, about 80 μm or more, about 90 μm or more, about 100 μm or more, about 110 μm or more, about 120 μm or more, about 130 μm or more, about 140 μm or more, about 150 μm or more, about 160 μm or more, about 170 μm or more, about 180 μm or more, about 190 μm or more, about 200 μm or more, about 300 μm or more, about 400 μm or more, about 500 μm or more, about 600 μm or more, about 700 μm or more, about 800 μm or more, or about 900 μm or more. Thus, the pores of the polishing pad body can have an average pore size bounded by any two of the foregoing endpoints. For example, the average pore size can be about 1 μm to about 5 μm, about 50 μm to about 110 μm, or about 180 μm to about 600 μm.

In a preferred embodiment, a substantial portion (e.g., about 50% or more) of the pores of the polishing pad body have a pore size of about 200 μm or less. For example, about 55% or more, e.g., about 60% or more, about 65% or more, about 70% or more, about 75% or more, about 80% or more, about 85% or more, about 90% or more, about 95% or more, or about 100% of the pores have a pore size of about 200 μm or less.

Typically, the polishing pad body comprises predominantly closed cells (i.e., pores). However, the polishing pad body can also comprise open cells. Preferably, the polishing pad body comprises a void volume of closed cells of about 5% or more, e.g., about 10% or more, about 15% or more, about 20% or more, about 25% or more, about 30% or more, about 35% or more, about 40% or more, about 45% or more, about 50% or more, about 60% or more, about 70% or more, about 80% or more, about 90% or more, or about 100% based on the total void volume of the polishing pad body.

The light-transmitting region has a second void volume (i.e., porosity) (as distinguished from the first void volume of the polishing pad body) and can be porous, substantially non-porous, or completely non-porous (i.e., 0% void volume). The second void volume of the light-transmitting region typically is smaller than the first void volume of the polishing pad body. For example, the second void volume can be about 0% or more, e.g., about 0.05% or more, about 0.1% or more, about 0.15% or more, about 0.2% or more, about 0.25% or more, about 0.3% or more, about 0.35% or more, about 0.4% or more, about 0.45% or more, about 0.5% or more, about 0.55% or more, about 0.6% or more, about 0.65% or more, about 0.7% or more, about 0.75% or more, about 0.8% or more, about 0.85% or more, about 0.9% or more, about 0.95% or more, about 1% or more, about 1.1% or more, about 1.2% or more, about 1.3% or more, about 1.4% or more, about 1.5% or more, about 1.6% or more, about 1.7% or more, about 1.8% or more, about 1.9% or more, about 2% or more, about 2.5% or more, about 3% or more, about 3.5% or more, about 4% or more, about 4.5% or more, about 5% or more, about 5.5% or more, about 6% or more, about 6.5% or more, about 7% or more, about 7.5% or more, about 8% or more, about 8.5% or more, about 9% or more, or about 9.5% or more. Alternatively, or in addition, the second void volume can be about 10% or less, e.g., about 9.5% or less, about 9% or less, about 8.5% or less, about 8% or less, about 7.5% or less, about 7% or less, about 6.5% or less, about 6% or less, about 5.5% or less, about 5% or less, about 4.5% or less, about 4% or less, about 3.5% or less, about 3% or less, about 2.5% or less, about 2% or less, about 1.9% or less, about 1.8% or less, about 1.7% or less, about 1.6% or less, about 1.5% or less, about 1.4% or less, about 1.3% or less, about 1.2% or less, about 1.1% or less, about 1% or less, about 0.95% or less, about 0.9% or less, about 0.85% or less, about 0.8% or less, about 0.75% or less, about 0.7% or less, about 0.65% or less, about 0.6% or less, about 0.55% or less, about 0.5% or less, about 0.45% or less, about 0.4% or less, about 0.35% or less, about 0.3% or less, about 0.25% or less, about 0.2% or less, about 0.15% or less, about 0.1% or less, or about 0.05% or less. Thus, the second void volume of the light-transmitting region can be bounded by any two of the foregoing endpoints. For example, the second void volume can be about 0.1% to about 10%, about 0.05% to about 1.9%, or about 0.5% to about 1%. In one embodiment, the second void volume is 0%.

When the light-transmitting region has pores, the pores can have any suitable average pore size. As used herein, the term "average pore size" refers to the average pore diameter. For example, the pores of the light-transmitting region can have an average pore size of about 200 μm or less, e.g., about 100 μm or less, about 90 μm or less, about 80 μm or less, about 70 μm or less, about 60 μm or less, about 50 μm or less, about 40 μm or less, about 30 μm or less, about 20 μm or less, about 10 μm or less, about 5 μm or less, about 1 μm or less, about 0.9 μm or less, about 0.8 μm or less, about 0.7 μm or less, about 0.6 μm or less, about 0.5 μm or less, about 0.4 μm or less, about 0.3 μm or less, about 0.2 μm or less, about 0.1 μm or less, or about 0.05 μm or less. Alternatively, or in addition, the pores of the light-transmitting region can have an average pore size of about 0.01 μm or more, e.g., about 0.05 μm or more, about 0.1 μm or more, about 0.2 μm or more, about 0.3 μm or more, about 0.4 μm or more, about 0.5 μm or more, about 0.6 μm or more, about 0.7 μm or more, about 0.8 μm or more, about 0.9 μm or more, about 1 μm or more, about 5 μm or more, about 10 μm or more, about 20 μm or more, about 30 μm or more, about 40 μm or more, about 50 μm or more, about 60 μm or more, about 70 μm or more, about 80 μm or more, about 90 μm or more, or about 100 μm or more. Thus, the average pore size of the pores comprising the light-transmitting region can be bounded by any two of the foregoing endpoints. For example, the average pore size can be about 0.05 μm to about 1 μm, about 0.2 μm to about 0.8 μm, or about 10 μm to about 100 μm.

In a preferred embodiment, a substantial portion (e.g., about 50% or more) of the pores of the light-transmitting region have a pore size of about 1 μm or less. For example, about 55% or more, e.g., about 60% or more, about 65% or more, about 70% or more, about 75% or more, about 80% or more, about 85% or more, about 90% or more, about 95% or more, or about 100% of the pores have a pore size of about 1 μm or less.

Typically, the light-transmitting region(s) comprises predominantly closed cells (i.e., pores). However, the light-transmitting region(s) can also comprise open cells. Preferably, the light-transmitting region(s) comprises a void volume of closed cells of about 5% or more, e.g., about 10% or more, about 15% or more, about 20% or more, about 25% or more, about 30% or more, about 35% or more, about 40% or more, about 45% or more, about 50% or more, about 60% or more, about 70% or more, about 80% or more, about 90% or more, or about 100% based on the total void volume of the light-transmitting region(s).

The polishing pad body typically is substantially or entirely opaque. Without wishing to be bound by any particular theory, it is believed that the pores in the polishing pad body cause light passing through the porous structure to scatter, thereby reducing the translucency of the polishing pad body or rendering the polishing pad body opaque. The degree of light scattering is believed to be a function of average pore size and average pore volume. It is further believed that compressing the polishing pad reduces the light-scattering effect of the pores by reducing the porosity (e.g., void volume) of the polishing pad in the region that is compressed. As a result, the compressed region (e.g., a light-transmitting region of the polishing pad) has an increased light transmittance (i.e., decreased level of light scattering and increased translucence) as compared to the polishing pad that is not compressed (i.e., the polishing pad body).

As will be appreciated by those of ordinary skill in the art, the degree of translucence provided in this manner will depend, at least in part, on the degree to which the porous structure is compressed (i.e., the degree to which the porosity of the porous structure is reduced). For example, the polishing pad body can be compressed by about 10-50% (e.g., about 20-40%, or about 10-30%) of its thickness prior to compression (i.e., the non-compressed thickness of the polishing pad).

The material comprising the polishing pad body can be the same as or different from the material comprising the light-transmitting region(s). In general, the material comprising the polishing pad body can be comprised of any polymer material that is compatible with chemical-mechanical polishing. In this respect, the material comprising the polishing pad body can be selected from the polymers recited herein for use in the light-transmitting region(s), the polymers recited herein that are not preferred for use in the light transmitting region (i.e., so called "non-preferred" polymers), or any combination thereof. Suitable polymers for the polishing pad body include, for example, thermoplastic elastomers, thermoplastic polyurethanes, polyolefins, polycarbonates, polyvinylalcohols, nylons, elastomeric rubbers, styrenic polymers, polyaromatics, fluoropolymers, polyimides, cross-linked polyurethanes, cross-linked polyolefins, polyethers, polyesters, polyacrylates, elastomeric polyethylenes, polytetrafluoroethylenes, polyethyleneteraphthalates, polyimides, polyaramides, polyarylenes, polystyrenes, polymethylmethacrylates, copolymers and block copolymers thereof, and mixtures and blends thereof. Preferably, the polymer resin is thermoplastic polyurethane, such as a methylenediphenyl diisocyanate-based thermoplastic polyurethane.

The polymeric resin (e.g., polymeric material) comprising the material of the light-transmitting region and/or the polishing pad body can have any suitable molecular weight. The molecular weight of the polymeric resin determines, in part, the rheological properties of the polymeric resin, such that the molecular weight of the polymeric resin is important for the forming (e.g., extrusion, injection molding, etc.) properties of polymeric resin. The molecular weight of the polymeric resin comprising the light-transmitting region and/or polishing pad body can be about 50,000 g/mol to about 300,000 g/mol. For example, the molecular weight can be about 50,000 g/mol or more, e.g., about 60,000 g/mol or more, about 70,000 g/mol or more, about 80,000 g/mol or more, about 90,000 g/mol or more, about 100,000 g/mol or more, about 120,000 g/mol or more, about 140,000 g/mol or more, about 160,000 g/mol or more, about 180,000 g/mol or more, about 200,000 g/mol or more, about 220,000 g/mol or more, about 240,000 g/mol or more, about 260,000 g/mol or more, or about 280,000 g/mol or more. Alternatively, or in addition, the molecular weight can be about 300,000 g/mol or less, e.g., about 280,000 g/mol or less, about 260,000 g/mol or less, about 240,000 g/mol or less, about 220,000 g/mol or less, about 200,000 g/mol or less, about 180,000 g/mol or less, about 160,000 g/mol or less, about 140,000 g/mol or less, about 120,000 g/mol or less, about 100,000 g/mol or less, about 90,000 g/mol or less, about 80,000 g/mol or less, about 70,000 g/mol or less, or about 60,000 g/mol or less. Thus, the molecular weight of the polymeric resin comprising the material of the light-transmitting region and/or polishing pad body can be bounded by any two of the foregoing endpoints. For example, the molecular weight can be about 50,000 g/mol to about 80,000 g/mol, about 70,000 g/mol to about 220,000 g/mol, or about 60,000 g/mol to about 70,000 g/mol.

The polymeric resin (e.g., polymeric material) comprising the material of the light-transmitting region and/or the polishing pad body can have any suitable polydispersity index (PDI). The PDI of the polymeric resin determines, in part, the rheological properties of the polymeric resin, such that the PDI of the polymeric resin is important for the forming (e.g., extrusion, injection molding, etc.) properties of polymeric resin. The PDI of the polymeric resin is typically about 1.1 to about 6, preferably about 2 to about 4.

The polishing pad, polishing pad body, and/or light-transmitting region(s) can be formed by any suitable technique known in the art. For example, the polishing pad, polishing pad body, and/or light-transmitting region(s) can be formed by film or sheet extrusion, injection molding, blow molding, thermoforming, compression molding, co-extrusion molding, reaction injection molding, profile extrusion molding, rotational molding, gas injection molding, film insert molding, foaming, casting, compression, or any combination thereof. For example, when the polishing pad, polishing pad body, and/or light-transmitting region(s) are made of, for example, a thermoplastic material (e.g., thermoplastic polyurethane), the thermoplastic material can be heated to a temperature at which it will flow and is then formed into a desired shape by, for example, casting or extrusion.

When the material comprising the polishing pad body is the same as the material comprising the light-transmitting regions(s), the light-transmitting region of the polishing pad can be formed, for example, by compressing at least a portion of the polishing pad, which is substantially or entirely opaque, to form one or more light-transmitting region(s) of the polishing pad that are optically transmissive. The term "optically transmissive" as used herein, refers to the ability to transmit at least a portion of light contacting the surface of the polishing pad and can be used to describe slightly, partially, substantially, and completely translucent or transparent materials. The compressed, optically transmissive region of the polishing pad body is a light-transmitting region of the invention having the properties described herein.

Compression of the polishing pad to form a light-transmitting region can be performed in any suitable manner known in the art. See, e.g., U.S. Pat. No. 6,840,843, hereby incorporated by reference in its entirety. As will be appreciated by those of ordinary skill in the art, the most effective technique of compression will depend, at least in part, on the particular polymer(s) (e.g., polymeric resins) used in the fabrication of the polishing pad. The polishing pad can be compressed, for example, by use of radio frequency (RF) welding techniques, by use of calendar rollers, or by use of various pressing mechanisms known in the art, such as a platen press, stamping machine, and the like. Furthermore, heat can be used, either alone or in conjunction with other compression techniques, to achieve a compressed structure. For example, the polishing pad can be heated to a temperature approaching, meeting, or exceeding its softening or melting temperature for a time sufficient to allow the pores of the polishing pad body to collapse under the weight of the polymer used in the construction of the polishing pad body. Alternatively, heat can be applied to the polishing pad before, during, or after compressing of the polishing pad using another compression technique. For example, an RF welding process can use a die or dies in conjunction with application of radiofrequency energy in the megahertz region to cause heating of the polishing pad that is in contact with the die or dies to cause compression of the polishing pad. In another example, a heated press or heated rollers can be used to compress the polishing pad so as to compress a region of the polishing pad. When using heat in conjunction with another compression technique to compress the polishing pad, the polishing pad is preferably heated to a temperature that approaches, meets, or exceeds the softening or melting temperature of the polishing pad.

When the light-transmitting region(s) is not formed by compressing at least a portion of the polishing pad, the light-transmitting region(s) can be produced separately and then attached to the polishing pad body by any suitable technique known in the art. In such a situation, the material comprising the light-transmitting region can be the same or different from the material comprising the polishing pad body. Typically, a portion of the polishing pad is removed therefrom, so as to obtain a polishing pad body containing an empty void. The light-transmitting region(s) can be produced separately by any suitable technique, as described elsewhere herein, and then the light-transmitting region can be conformed, e.g., trimmed, to match the size of the void in the polishing pad body. The conformed light-transmitting region can then be placed in the void and attached to the polishing pad body by a suitable process, such as a process selected from the group consisting of a heat-melting chemical bond fusion, ultrasonic welding (see, e.g., U.S. Pat. No. 6,997,777, hereby incorporated by reference in its entirety), radio frequency (RF) welding, arc welding, heat compression, frictional heating, and combinations thereof. In a preferred embodiment, the conformed light-transmitting region is not attached to the polishing pad body by an adhesive.

RF welding can involve positioning a light-transmitting region to be welded to the polishing pad and using a die to direct the welding process. High frequency waves in the megahertz frequency range are passed through the materials with the result that the pieces are heated, and the light-transmitting region(s) becomes attached to the polishing pad. Ultrasonic welding can involve the use of high frequency sound waves to melt the materials comprising the light-transmitting region(s) and the polishing pad, thereby causing the materials to flow together so that the light-transmitting region(s) becomes attached to the polishing pad. Typically, the source of ultrasonic waves is a sound-generating metal tuning device (e.g., a "horn") that converts a high frequency electrical signal into sound in the kilohertz frequency range, although any suitable source of ultrasonic sound can be used. The horn can be any suitable horn, for example, a stainless steel horn. The horn can have any suitable shape or configuration and preferably is machined to have a similar shape, or even an identical shape, to the shape of the light-transmitting region(s).

The polishing pad can comprise one or more light-transmitting regions, each of which can be prepared in the same or different manner (e.g., one region formed by compression, and one region produced separately and then welded to the polishing pad) and/or each of which can be comprised of the same or different material(s) (e.g., different polymeric resins and/or light-absorbing compounds). The polishing pad can comprise one, two, three, four, five, six, seven, eight, nine, or ten light-transmitting regions.

The light-transmitting region(s) can comprise a portion of the polishing pad, or the light-transmitting region(s) can comprise the entire polishing pad. For example, the light-transmitting region(s) can comprise about 5% or more, e.g., about 10% or more, about 15% or more, about 20% or more, about 25% or more, about 30% or more, about 35% or more, about 40% or more, about 45% or more, about 50% or more, about 55% or more, about 60% or more, about 65% or more, about 70% or more, about 75% or more, about 80% or more, about 85% or more, about 90% or more, about 95% or more, or about 100% of the polishing pad by surface area. Alternatively, the light-transmitting region(s) can comprise about 100% or less, e.g., about 95% or less, about 90% or less, about 85% or less, about 80% or less, about 75% or less, about 70% or less, about 65% or less, about 60% or less, about 55% or less, about 50% or less, about 45% or less, about 40% or less, about 35% or less, about 30% or less, about 25% or less, about 20% or less, about 15% or less, or about 10% or less of the polishing pad by surface area. Thus, the portion of the polishing pad comprised by the light-transmitting region can be bounded by any two of the foregoing endpoints. For example, the light-transmitting region can comprise about 10% to about 35%, about 30% to about 55%, or about 60% to about 95% of the polishing pad by surface area. In a preferred embodiment, the polishing pad comprises one light-transmitting region, in which the light-transmitting region does not comprise the entire polishing pad. In another embodiment, the polishing pad comprises one light-transmitting region, in which the entire polishing pad (i.e., 100% by surface area) is a light-transmitting region, i.e., the entire polishing pad is composed of a material suitable for use as a light-transmitting region, which material has been suitably processed (e.g., compressed, extruded, and/or molded) so as to have the properties recited herein for the light-transmitting region.

The light-transmitting region(s) can be positioned in any suitable location of the polishing pad, and the light-transmitting region(s) can have any suitable shape, dimension, or configuration. For example, the light-transmitting region(s) can have the shape of a circle, an oval, a rectangle, or a square. When the light-transmitting region(s) is oval or rectangular in shape, the light-transmitting region(s) typically has a maximum length of about 3 cm to about 8 cm. When the light-transmitting region(s) is circular or square in shape, the region(s) typically has a diameter or width of about 1 cm to about 4 cm.

The light-transmitting region(s) can have any suitable thickness. Typically, the light-transmitting region(s) has a thickness of about 0.2 mm or more, e.g., about 0.3 mm or more, about 0.4 mm or more, about 0.5 mm or more, about 0.6 mm or more, about 0.7 mm or more, about 0.8 mm or more, about 0.9 mm or more, about 1 mm or more, about 1.1 mm or more, about 1.2 mm or more, about 1.3 mm or more, about 1.4 mm or more, about 1.5 mm or more, about 1.6 mm or more, about 1.7 mm or more, about 1.8 mm or more, about 1.9 mm or more, about 2 mm or more, about 2.2 mm or more, about 2.4 mm or more, about 2.6 mm or more, or about 2.8 mm or more. Alternatively, or in addition, the light-transmitting region(s) has a thickness of about 3 mm or less, e.g., about 2.8 mm or less, about 2.6 mm or less, about 2.4 mm or less, about 2.2 mm or less, about 2 mm or less, about 1.9 mm or less, about 1.8 mm or less, about 1.7 mm or less, about 1.6 mm or less, about 1.5 mm or less, about 1.4 mm or less, about 1.3 mm or less, about 1.2 mm or less, about 1.1 mm or less, about 1 mm or less, about 0.9 mm or less, about 0.8 mm or less, about 0.7 mm or less, about 0.6 mm or less, about 0.5 mm or less, about 0.4 mm or less, or about 0.3 mm or less. Thus, the thickness of the light-transmitting region(s) can be bounded by any two of the foregoing endpoints. For example, the thickness of the light-transmitting region can be about 0.2 to about 3 mm, about 0.2 mm to about 1 mm, or about 0.5 mm to about 1.6 mm. In a preferred embodiment, the thickness of the light transmitting region is about 1 mm.

The material comprising the light-transmitting region, which material is composed of at least one polymeric resin and at least one light-absorbing compound, can be formed in any suitable manner. For example, in the polymerization medium that is used to form the polymeric resin, e.g., by using a suitable polymerization technique such as condensation polymerization, a light-absorbing compound can be added to this polymerization medium prior to, during, or after polymerization, so as to form a polymeric resin with a light-absorbing compound dispersed therein. In another embodiment, the polymeric resin can be either purchased commercially or synthesized using conventional polymerization techniques (e.g., condensation polymerization), and then both the polymeric resin and light-absorbing compound can be dissolved in a suitable solvent (e.g., an organic solvent such as tetrahydrofuran). The solution containing the polymeric resin and light-absorbing compound can be subjected to reduced pressure and/or heat in order to remove the solvent, thereby obtaining a polymeric resin with a light-absorbing compound dispersed therein. In yet another embodiment, a pre-synthesized and/or commercially purchased polymeric resin and a light-absorbing compound can be melt blended together, which technique comprises heating the polymeric resin to a sufficient temperature so as to melt the polymer. A light-absorbing compound can be added prior to, during, or after the polymeric resin has melted, so as to obtain a polymeric resin with a light-absorbing compound dispersed therein.

When a degree of porosity is desired in the polishing pad body and/or light-transmitting region(s), the polymer resin comprising the polishing pad body and/or light-transmitting region(s) may provide a porous structure by virtue of their natural configuration. In other embodiments, the porous structure may be introduced through the use of various production techniques known in the art (e.g., foaming, blowing, and the like). Representative methods providing a porous structure comprising closed-cell pores include foaming processes such as a Mucell process, a phase inversion process, a spinodal or bimodal decomposition process, or a pressurized gas injection process, all of which are well-known in the art. A representative method providing a porous structure comprising open-cell pores comprises sintering particles of a thermoplastic polymer, such as a thermoplastic polyurethane, to provide an open-cell porous structure.

The polishing pad can have any suitable dimensions. Typically, the polishing pad is circular in shape (as is used in rotary polishing tools) or is produced as a looped linear belt (as is used in linear polishing tools). Preferably, the polishing pad is circular.

The light-transmitting region(s) and/or polishing pad body can have one or more of the following properties: (a) a Shore hardness of about 10 A to about 80 D, (b) a porosity in which the pores can have a certain size and proportion (as already described herein), (c) a % elongation of greater than about 50%, (d) an ultimate tensile strength of greater than about 65 kPa, (e) a flexural modulus at room temperature of about 700 kPa to about 3,500,000 kPa, (f) a resin melt index or melt flow rate of less than about 500 g/10 min at about 2160 g load at about 210° C., (g) a resin melt viscosity range of about 10 Pa·s to about 20,000 Pa·s., as measured by a capillary rheometer at a shear rate of about 18/s at about 210° C., (h) a % crystallinity, (i) a glass transition temperature of about −100° C. to about 160° C., (j) a surface roughness of about 0.1 to about 100 μm, and (k) a refractive index of about 1.1 to about 2.0. The foregoing properties will determine, in part, the rheological properties of the polymeric resin, which properties are important for ensuring that the polymer can be suitably molded (e.g., extruded or injection molded) into a polishing pad body and/or light-transmitting region. The foregoing properties are also important for determining the structural properties of the polishing pad body and/or light-transmitting region, to ensure, for example, that the polishing pad can be suitably used in chemical-mechanical polishing. For example, the foregoing properties ensure that a polishing pad is compatible with polishing compositions, can withstand physical and chemical abrasion, and can suitably abrade and planarize a substrate surface.

The light-transmitting region(s) and/or polishing pad body typically are formed from a polymeric resin. The light-transmitting region(s), polishing pad body, and/or polymeric resin can have any suitable Shore hardness. The Shore hardness depends, for example, on the material comprising the polishing pad and the method of producing the polishing pad. Both the Shore A and Shore D scales span from 0 to 100, are a measure of a material's hardness, and are measured according to ASTM D2240-10, hereby incorporated by reference in its entirety. The Shore A scale is typically used for relatively softer materials, whereas the Shore D scale is typically used for relatively harder materials; however, there is some overlap between the scales. The Shore A hardness of the light-transmitting region(s), polishing pad body, and/or polymeric resin can be about 10 or more, e.g., about 20 or more, about 30 or more, about 40 or more, about 50 or more, about 60 or more, about 70 or more, about 80 or more, or about 90 or more. Alternatively, or in addition, the Shore A hardness of the light-transmitting region(s), polishing pad body, and/or polymeric resin can be about 100 or less, e.g., about 90 or less, about 80 or less, about 70 or less, about 60 or less, about 50 or less, about 40 or less, about 30 or less, or about 20 or less. The Shore D hardness of the light-transmitting region(s), polishing pad body, and/or polymeric resin can be greater than about 0, e.g., about 10 or more, about 20 or more, about 30 or more, about 40 or more, about 50 or more, about 60 or more, or about 70 or more. Alternatively, or in addition, the Shore D hardness of the light-transmitting region(s), polishing pad body, and/or polymeric resin can be about 80 or less, e.g., about 70 or less, about 60 or less, about 50 or less, about 40 or less, about 30 or less, about 20 or less, or about 10 or less. Thus, the Shore hardness of the light-transmitting region(s), polishing pad body, and/or polymeric resin can be bounded by any two of the foregoing endpoints. For example, the Shore hardness of the light-transmitting region(s), polishing pad body, and/or polymeric resin can be from about 10 A to about 50 A, about 20 A to about 50 D, or about 20 D to about 70 D.

The light-transmitting region(s) and/or polishing pad body can have any suitable % elongation. The % elongation is measured according to ASTM D412-06a, hereby incorporated by reference in its entirety. The % elongation depends, for example, on the material comprising the polishing pad and the method of producing the polishing pad. The % elongation of the light-transmitting region(s) and/or polishing pad body can be about 50% or more, e.g., about 60% or more, about 80% or more, about 100% or more, about 120% or more, about 140% or more, about 160% or more, about 180% or more, about 200% or more, about 220% or more, about 240% or more, about 260% or more, about 280% or more, about 300% or more, about 320% or more, about 340% or more, about 360% or more, about 380% or more, about 400% or more, about 500% or more, about 600% or more, about 700% or more, about 800% or more, about 900% or more, about 1,000% or more, or about 1,100% or more. Alternatively, or in addition, the % elongation of the light-transmitting region(s) and/or polishing pad body can be about 1,200% or less, e.g., about 1,100% or less, about 1,000% or less, about 900% or less, about 800% or less, about 700% or less, about 600% or less, about 500% or less, about 400% or less, about 380% or less, about 360% or less, about 340% or less, about 320% or less, about 300% or less, about 280% or less, about 260% or less, about 240% or less, about 220% or less, about 200% or less, about 180% or less, about 160% or less, about 140% or less, about 120% or less, about 100% or less, about 80% or less, or about 60% or less. Thus, the % elongation of the light-transmitting region(s) and/or polishing pad body can be bounded by any two of the foregoing endpoints. For example, the % elongation of the light-transmitting region(s) and/or polishing pad body can be about 60% to about 180%, about 100% to about 120%, or about 300% to about 400%. In a preferred embodiment, the % elongation is about 100% to about 700%.

The light-transmitting region(s) and/or polishing pad body can have any suitable ultimate tensile strength. The ultimate tensile strength depends, for example, on the material comprising the polishing pad and the method of producing the polishing pad. The ultimate tensile strength is measured according to ASTM D412-06a, hereby incorporated by reference in its entirety. The ultimate tensile strength of the light-transmitting region(s) and/or polishing pad body can be about 65 kPa or more, e.g., about 100 kPa or more, about 200 kPa or more, about 400 kPa or more, about 600 kPa or more, about 800 kPa or more, about 1,000 kPa or more, about 2,000 kPa or more, about 3,000 kPa or more, about 4,000 kPa or more, about 5,000 kPa or more, about 6,000 kPa or more, about 7,000 kPa or more, about 8,000 kPa or more, about 9,000 kPa or more, about 10,000 kPa or more, about 15,000 kPa or more, about 20,000 kPa or more, about 25,000 kPa or more, about 30,000 kPa or more, about 35,000 kPa or more, about 40,000 kPa or more, about 45,000 kPa or more, about 50,000 kPa or more, about 55,000 kPa or more, about 60,000 kPa or more, about 65,000 kPa or more, about 70,000 kPa or more, about 75,000 kPa or more, about 80,000 kPa or more, about 85,000 kPa or more, about 90,000 kPa or more, about 95,000 kPa or more, about 100,000 kPa or more, about 200,000 kPa or more, about 300,000 kPa or more, about 400,000 kPa or more, about 500,000 kPa or more, about 600,000 kPa or more, about 700,000 kPa or more, about 800,000 kPa or more, or about 900,000 kPa or more. Alternatively, or in addition, the ultimate tensile strength of the light-transmitting region(s) and/or polishing pad body can be about 1,000,000 kPa or less, e.g., about 900,000 kPa or less, about 800,000 kPa or less, about 700,000 kPa or less, about 600,000 kPa or less, about 500,000 kPa or less, about 400,000 kPa or less, about 300,000 kPa or less, about 200,000 kPa or less, about 100,000 kPa or less, about 95,000 kPa or less, about 90,000 kPa or less, about 85,000 kPa or less, about 80,000 kPa or less, about 75,000 kPa or less, about 70,000 kPa or less, about 65,000 kPa or less, about 60,000 kPa or less, about 55,000 kPa or less, about 50,000 kPa or less, about 45,000 kPa or less, about 40,000 kPa or less, about 35,000 kPa or less, about 30,000 kPa or less, about 25,000 kPa or less, about 20,000 kPa or less, about 15,000 kPa or less, about 10,000 kPa or less, about 9,000 kPa or less, about 8,000 kPa or less, about 7,000 kPa or less, about 6,000 kPa or less, about 5,000 kPa or less, about 4,000 kPa or less, about 3,000 kPa or less, about 2,000 kPa or less, about 1,000 kPa or less, about 800 kPa or less, about 600 kPa or less, about 400 kPa or less, about 200 kPa or less, or about 100 kPa or less. Thus, the ultimate tensile strength of the light-transmitting region(s) and/or polishing pad body can be bounded by any two of the foregoing endpoints. For example, the ultimate tensile strength of the light-transmitting region(s) and/or polishing pad body can be about 65 kPa to about 1,000 kPa, about 80 kPa to about 200 kPa, or about 45,000 kPa to about 65,000 kPa. In a preferred embodiment, the ultimate tensile strength of the light-transmitting region(s) and/or polishing pad body is about 10,000 kPa to about 100,000 kPa.

The light-transmitting region(s) and/or polishing pad body can have any suitable flexural modulus. The flexural modulus depends, for example, on the material comprising the polishing pad and the method of producing the polishing pad. The flexural modulus is measured according to ASTM D790-10, hereby incorporated by reference in its entirety. The flexural modulus of the light-transmitting region(s) and/or polishing pad body can be about 700 kPa or more, e.g., about 800 kPa or more, about 900 kPa or more, about 1,000 kPa or more, about 2,000 kPa or more, about 3,000 kPa or more, about 4,000 kPa or more, about 5,000 kPa or more, about 10,000 kPa or more, about 20,000 kPa or more, about 30,000 kPa or more, about 40,000 kPa or more, about 50,000 kPa or more, about 100,000 kPa or more, about 200,000 kPa or more, about 300,000 kPa or more, about 400,000 kPa or more, about 500,000 kPa or more, about 1,000,000 kPa or more, about 2,000,000 kPa or more, or about 3,000,000 kPa or more. Alternatively, or in addition, the flexural modulus of the light-transmitting region(s) and/or polishing pad body can be about 3,500,000 kPa or less, e.g., about 3,000,000 kPa or less, about 2,000,000 kPa or less, about 1,000,000 kPa or less, about 500,000 kPa or less, about 400,000 kPa or less, about 300,000 kPa or less, about 200,000 kPa or less, about 100,000 kPa or less, about 50,000 kPa or less, about 40,000 kPa or less, about 30,000 kPa or less, about 20,000 kPa or less, about 10,000 kPa or less, about 5,000 kPa or less, about 4,000 kPa or less, about 3,000 kPa or less, about 2,000 kPa or less, about 1,000 kPa or less, about 900 kPa or less, or about 800 kPa or less. Thus, the flexural modulus of the light-transmitting region(s) and/or polishing pad body can be bounded by any two of the foregoing endpoints. For example, the flexural modulus of the light-transmitting region(s) and/or polishing pad body can be about 700 kPa to about 3,000 kPa, about 2,000 kPa to about 50,000 kPa, or about 10,000 kPa to about 1,000,000 kPa.

The material comprising the light-transmitting region(s) and/or polishing pad body can have any suitable resin melt index or melt flow rate. The resin melt index or melt flow rate depends, for example, on the material (e.g, the specific polymeric resin) comprising the polishing pad. The resin melt index or melt flow rate of a material (e.g., polymeric resin) provides a measure of the amount of material in grams flowing through an opening of a specified diameter in a specified amount of time at a given temperature, and thus the resin melt index or melt flow rate is related to the viscosity of the material. The resin melt index or melt flow rate as recited herein is measured at a temperature of about 210° C. and a load of 2160 g. The melt index or melt flow rate of the light-transmitting region(s) and/or polishing pad body can be about 10 g/10 min or more, e.g., about 20 g/10 min or more, about 30 g/10 min or more, about 40 g/10 min or more, about 50 g/10 min or more, about 60 g/10 min or more, about 70 g/10 min or more, about 80 g/10 min or more, about 90 g/10 min or more, about 100 g/10 min or more, about 150 g/10 min or more, about 200 g/10 min or more, about 250 g/10 min or more, about 300 g/10 min or more, about 350 g/10 min or more, about 400 g/10 min or more, or about 450 g/10 min or more. Alternatively, or in addition, the resin melt index or melt flow rate of the light-transmitting region(s) and/or polishing pad body can be about 500 g/10 min or less, e.g., about 450 g/10 min or less, about 400 g/10 min or less, about 350 g/10 min or less, about 300 g/10 min or less, about 250 g/10 min or less, about 200 g/10 min or less, about 150 g/10 min or less, about 100 g/10 min or less, about 90 g/10 min or less, about 80 g/10 min or less, about 70 g/10 min or less, about 60 g/10 min or less, about 50 g/10 min or less, about 40 g/10 min or less, about 30 g/10 min or less, or about 20 g/10 min or less. Thus, the resin melt index or melt flow rate of the light-transmitting region(s) and/or polishing pad body can be bounded by any two of the foregoing endpoints. For example, the resin melt index or melt flow rate of the light-transmitting region(s) and/or polishing pad body can be about 70 g/10 min to about 350 g/10 min, about 150 g/10 min to about 400 g/10 min, or about 100 g/10 min to about 500 g/10 min.

The light-transmitting region(s) and/or polishing pad body can have any suitable resin melt viscosity. The resin melt viscosity depends, for example, on the material comprising the polishing pad. The resin melt viscosity (Pa·s) is measured by a capillary rheometer at a shear rate of about 18/s at a temperature of about 210° C. The resin melt viscosity of the light-transmitting region(s) and/or polishing pad body can be about 10 Pa·s or more, e.g., about 50 Pa·s or more, about 100 Pa·s or more, about 200 Pa·s or more, about 300 Pa·s or more, about 400 Pa·s or more, about 500 Pa·s or more, about 600 Pa·s or more, about 700 Pa·s or more, about 800 Pa·s or more, about 900 Pa·s or more, about 1,000 Pa·s or more, about 2,000 Pa·s or more, about 3,000 Pa·s or more, about 4,000 Pa·s or more, about 5,000 Pa·s or more, about 6,000 Pa·s or more, about 7,000 Pa·s or more, about 8,000 Pa·s or more, about 9,000 Pa·s or more, about 10,000 Pa·s or more, about 11,000 Pa·s or more, about 12,000 Pa·s or more, about 13,000 Pa·s or more, about 14,000 Pa·s or more, about 15,000 Pa·s or more, about 16,000 Pa·s or more, about 17,000 Pa·s or more, about 18,000 Pa·s or more, or about 19,000 Pa·s or more. Alternatively, or in addition, the resin melt viscosity of the light-transmitting region(s) and/or polishing pad body can be about 20,000 Pa·s or less, e.g., about 19,000 Pa·s or less, about 18,000 Pa·s or less, about 17,000 Pa·s or less, about 16,000 Pa·s or less, about 15,000 Pa·s or less, about 14,000 Pa·s or less, about 13,000 Pa·s or less, about 12,000 Pa·s or less, about 11,000 Pa·s or less, about 10,000 Pa·s or less, about 9,000 Pa·s or less, about 8,000 Pa·s or less, about 7,000 Pa·s or less, about 6,000 Pa·s or less, about 5,000 Pa·s or less, about 4,000 Pa·s or less, about 3,000 Pa·s or less, about 2,000 Pa·s or less, about 1,000 Pa·s or less, about 900 Pa·s or less, about 800 Pa·s or less, about 700 Pa·s or less, about 600 Pa·s or less, about 500 Pa·s or less, about 400 Pa·s or less, about 300 Pa·s or less, about 200 Pa·s or less, about 100 Pa·s or less, or about 50 Pa·s or less. Thus, the resin melt viscosity of the light-transmitting region(s) and/or polishing pad body can be bounded by any two of the foregoing endpoints. For example, the resin melt viscosity of the light-transmitting region(s) and/or polishing pad body can be about 50 Pa·s to about 3,000 Pa·s, about 400 Pa·s to about 2,000 Pa·s, or about 15,000 Pa·s to about 18,000 Pa·s.

The light-transmitting region(s) can have any suitable % crystallinity. The % crystallinity depends, for example, on the material comprising the light-transmitting region(s) and the method of producing the light-transmitting region(s). The % crystallinity can be measured according to ASTM D3418-08, hereby incorporated by reference in its entirety. A high degree of crystallinity can prevent the light-transmitting region from possessing the light-transmitting properties recited herein, such that in general a lower degree of crystallinity is desirable. The % crystallinity of the light-transmitting region(s) can be greater than about 0%, e.g., about 1% or more, about 2% or more, about 4% or more, about 6% or more, about 8% or more, about 10% or more, about 12% or more, about 14% or more, about 16% or more, about 18% or more, about 20% or more, about 22% or more, about 24% or more, about 26% or more, or about 28% or more. Alternatively, or in addition, the % crystallinity of the light-transmitting region(s) can be about 30% or less, e.g., about 28% or less, about 26% or less, about 24% or less, about 22% or less, about 20% or less, about 18% or less, about 16% or less, about 14% or less, about 12% or less, about 10% or less, about 8% or less, about 6% or less, about 4% or less, about 2% or less, or about 1% or less. Thus, the % crystallinity of the light-transmitting region(s) can be bounded by any two of the foregoing endpoints. For example, the % crystallinity of the light-transmitting region(s) can be about 1% to about 10%, about 4% to about 22%, or about 12% to about 28%, depending, for example, on the desired light-transmitting properties of the light-transmitting region.

The polishing pad body can have any suitable % crystallinity. The % crystallinity depends, for example, on the material comprising the polishing pad body and the method of producing the polishing pad body. The % crystallinity can be measured as described above with respect to the % crystallinity of the light-transmitting region(s). The % crystallinity of the polishing pad body can be greater than about 0%, e.g., about 1% or more, about 5% or more, about 10% or more, about 15% or more, about 20% or more, about 25% or more, about 30% or more, about 35% or more, about 40% or more, about 45% or more, about 50% or more, or about 55% or more. Alternatively, or in addition, the % crystallinity of the polishing pad body can be about 60% or less, e.g., about 55% or less, about 50% or less, about 45% or less, about 40% or less, about 35% or less, about 30% or less, about 25% or less, about 20% or less, about 15% or less, about 10% or less, about 5% or less, or about 1% or less. Thus, the % crystallinity of the polishing pad body can be bounded by any two of the foregoing endpoints. For example, the % crystallinity of the polishing pad body can be about 1% to about 10%, about 2% to about 30%, or about 25% to about 45%, depending, for example, on the desired light-transmitting properties of the polishing pad body.

The light-transmitting region(s) and/or polishing pad body can have any suitable glass transition ($T_g$) temperature. The glass transition temperature depends, for example, on the material comprising the polishing pad. The glass transition temperature can be measured by conventional techniques, such as differential scanning calorimetry (DSC). The glass transition temperature of the light-transmitting region(s) and/or polishing pad body can be about −100° C. or more, e.g., about −90° C. or more, about −80° C. or more, about −70° C. or more, about −60° C. or more, about −50° C. or more, about −40° C. or more, about −30° C. or more, about −20° C. or more, about −10° C. or more, about 0° C. or more, about 10° C. or more, about 20° C. or more, about 30° C. or more, about 40° C. or more, about 50° C. or more, about 60° C. or more, about 70° C. or more, about 80° C. or more, about 90° C. or more, about 100° C. or more, about 110° C. or more, about 120° C. or more, about 130° C. or more, about 140° C. or more, or about 150° C. or more. Alternatively, or in addition, the glass transition temperature of the light-transmitting region(s) and/or polishing pad body can be about 160° C. or less, about 150° C. or less, about 140° C. or less, about 130° C. or less, about 120° C. or less, about 110° C. or less, about 100° C. or less, about 90° C. or less, about 80° C. or less, about 70° C. or less, about 60° C. or less, about 50° C. or less, about 40° C. or less, about 30° C. or less, about 20° C. or less, about 10° C. or less, about 0° C. or less, about −10° C. or less, about −20° C. or less, about −30° C. or less, about −40° C. or less, about −50° C. or less, about −60° C. or less, about −70° C. or less, about −80° C. or less, or about −90° C. or less. Thus, the glass transition temperature of the light-transmitting region(s) and/or polishing pad body can be bounded by any two of the foregoing endpoints. For example, the glass transition temperature of the light-transmitting region(s) and/or polishing pad body can be about −80° C. to about 10° C., about 0° C. to about 70° C., or about 110° C. to about 150° C.

The light-transmitting region(s) and/or polishing pad body can have any suitable surface roughness. The surface roughness of the light-transmitting region(s) and/or polishing pad body can result from the nature of the material and/or the process used to form the light-transmitting region(s) and/or polishing pad body. The surface roughness can be additionally or alternatively adjusted to the desired level of surface roughness by any suitable technique, such as by grinding. The surface roughness is measured according to ISO4287, hereby incorporated by reference in its entirety. The surface roughness of the light-transmitting region(s) and/or polishing pad body can be about 0.1 μm or more, e.g., about 0.5 μm or more, about 1 μm or more, about 5 μm or more, about 10 μm or more, about 15 μm or more, about 20 μm or more, about 25 μm or more, about 30 μm or more, about 35 μm or more, about 40 μm or more, about 45 μm or more, about 50 μm or more, about 55 μm or more, about 60 μm or more, about 65 μm or more, about 70 μm or more, about 75 μm or more, about 80 μm or more, about 85 μm or more, about 90 μm or more, or about 95 μm or more. Alternatively, or in addition, the surface roughness of the light-transmitting region(s) and/or polishing pad body can be about 100 μm or less, e.g., about 95 μm or less, about 90 μm or less, about 85 μm or less, about 80 μm or less, about 75 μm or less, about 70 μm or less, about 65 μm or less, about 60 μm or less, about 55 μm or less, about 50 μm or less, about 45 μm or less, about 40 μm or less, about 35 μm or less, about 30 μm or less, about 25 μm or less, about 20 μm or less, about 15 μm or less, about 10 μm or less, about 5 μm or less, about 1 μm or less, or about 0.5 μm or less. Thus, the surface roughness of the light-transmitting region(s) and/or polishing pad body can be bounded by any two of the foregoing endpoints. For example, the surface roughness of the light-transmitting region(s) and/or polishing pad body can be about 1 μm to about 20 μm, about 5 μm to about 80 μm, or about 30 μm to about 60 μm.

The light-transmitting region(s) and/or polishing pad body can have any suitable refractive index. The refractive index of the light-transmitting region desirably is similar to the refractive index of the polishing slurry used with the polishing pad, such that reflections at the window/slurry interface are minimized. The refractive index can be measured by conventional techniques, such as by using a refractometer. The refractive index of the light-transmitting region(s) and/or polishing pad body can be about 1.1 or more, e.g., about 1.2 or more, about 1.3 or more, about 1.4 or more, about 1.5 or more, about 1.6 or more, about 1.7 or more, about 1.8 or more, or about 1.9 or more. Alternatively, or in addition, the refractive index can be about 2.0 or less, e.g., about 1.9 or less, about 1.8 or less, about 1.7 or less, about 1.6 or less, about 1.5 or less, about 1.4 or less, about 1.3 or less, or about 1.2 or less. Thus, the refractive index of the light-transmitting region(s) and/or polishing pad body can be bounded by any two of the foregoing endpoints. For example, the refractive index of the light-transmitting region(s) and/or polishing pad body can be about 1.3 to about 1.5, about 1.2 to about 1.4, or about 1.6 to about 1.9.

In some embodiments, the polishing pad (i.e., the polishing pad body and/or light-transmitting region(s)) can have a surface texture. The surface texture facilitates the lateral transport of a polishing composition across the surface of the polishing pad during polishing. The surface texture can be provided using any suitable technique, such as any standard pad conditioning method. An example of a suitable technique is embossing the surface of the polishing pad. Embossing can provide a variety of patterns, such as dimples, hexagonal patterns, grooves, channels, and/or perforations. The polishing pad can have two or more different patterns. For example, a combination of large grooves and small grooves can be used. The grooves can be in the form of slanted grooves, concentric grooves, spiral or circular grooves, and XY cross-hatch pattern, and can be continuous or non-continuous in connectivity. Other suitable surface texture patterns can be readily utilized.

The surface texture can be embossed into a surface of the polishing pad by using an RF welding tool having features that transfer to the surface of the polishing pad during the welding process that integrates/attaches the light-transmitting region into the polishing pad. Alternatively, the surface texture can be embossed into a surface of the polishing pad prior to integration into the polishing pad. In addition, the formation of a surface texture on the surface of a porous polishing pad typically results in the formation of higher and lower porosity regions within the polishing pad corresponding to the different degrees of compression that result in formation of the texture pattern.

The surface texture of the polishing pad can be tailored to provide a desired amount of light transmission. The presence of a surface texture can result in greater light scattering of an incident beam of radiation. Thus, the density and type of surface texture can be selected to provide the desired light transmission properties. In addition, alteration of the degree of porosity of the polishing pad by, for example, embossing also can affect light scattering caused by pores.

A polishing pad in accordance with the invention can be used alone or optionally can be used as one layer of a multi-layer stacked polishing pad, the structure of which is well-known in the art. See, e.g., U.S. Pat. No. 6,884,156, hereby incorporated by reference in its entirety. For example, the inventive polishing pad can be used in combination with a subpad. The subpad can be any suitable subpad. Suitable subpads include polyurethane foam subpads, impregnated felt subpads, microporous polyurethane subpads, and sintered urethane subpads. The subpad typically is softer than the polishing pad of the invention and therefore is more compressible than the polishing pad. In some embodiments, the subpad is harder and is less compressible than the polishing pad. The subpad contains at least one window or aperture to expose the light-transmitting region of the polishing pad. The subpad optionally comprises grooves, channels, hollow sections, and the like. When the polishing pad of the invention is used in combination with a subpad, typically there is an intermediate backing layer, such as a polyethyleneterephthalate film, coextensive with and between the polishing pad and the subpad. The subpad and/or backing layer can be comprised of the same or different material as the polishing pad body and/or light-transmitting region(s). In some embodiments, the subpad and/or backing layer can be comprised of the inventive material described herein. In other embodiments, the subpad and/or backing layer is comprised of a material that is not the inventive material described herein.

The invention further provides a method of polishing a workpiece, which method comprises (a) providing a workpiece to be polished, (b) contacting the workpiece with a polishing pad and a chemical-mechanical polishing composition, and (c) moving the workpiece relative to the polishing pad so as to abrade at least a portion of the surface of the workpiece to polish the workpiece, wherein the polishing pad comprises a polishing pad body and at least one light-transmitting region, the light-transmitting region is composed of a material comprising (i) a polymeric resin and (ii) at least one light-absorbing compound, and the light-transmitting region has a total light transmittance of about 25% or more at one or more wavelengths in a range of 250 nm to 395 nm.

In a preferred embodiment, the method of polishing a workpiece further comprises detecting a polishing endpoint in situ. In a preferred embodiment, the polishing endpoint is detected using light. Detecting a polishing endpoint in situ using light comprises irradiating the polishing pad and workpiece assembly with light during the polishing process such that the light passes through at least one light-transmitting region of the polishing pad. After passing through the at least one light-transmitting region, the light strikes the surface of the workpiece being polished, the light reflects off of the workpiece and passes back through the light-transmitting region, and the reflected light is detected by one or more light detectors that analyzes and/or records the properties (e.g., intensity, wavelength, absorption, transmission, etc.) of the reflected light. The reflected light is monitored until it is determined that the desired degree of planarization and/or abrasion of the substrate is achieved, as indicated by, for example, a change in the intensity of the reflected light, a blue shift to shorter wavelengths or a red shift to longer wavelengths of the reflected light, and the like, or combinations thereof. The intensity changes and/or blue or red shifts, or the like, are measured relative to the properties of the reflected light prior to a given event that transpires during the polishing process, e.g., achieving the desired level of planarization.

The light that is used to detect a polishing endpoint in situ can comprise one or more single wavelengths (e.g., 250 nm, 255 nm, 260 nm, 265 nm, 270 nm, 275 nm, 280 nm, 285 nm, 290 nm, 295 nm, 300 nm, 305 nm, 310 nm, 315 nm, 320 nm, 325 nm, 330 nm, 335 nm, 340 nm, 345 nm, 350 nm, 355 nm, 360 nm, 365 nm, 370 nm, 375 nm, 380 nm, 385 nm, 390 nm, or 395 nm), and/or the light can comprise one or more ranges of wavelengths in a range of 250 nm to 395 nm. For example, the wavelength of light can be within a range of 250 nm or more, e.g., 255 nm or more, 260 nm or more, 265 nm or more, 270 nm or more, 275 nm or more, 280 nm or more, 285 nm or more, 290 nm or more, 295 nm or more, 300 nm or more, 305 nm or more, 310 nm or more, 315 nm or more, 320 nm or more, 325 nm or more, 330 nm or more, 335 nm or more, 340 nm or more, 345 nm or more, 350 nm or more, 355 nm or more, 360 nm or more, 365 nm or more, 370 nm or more, 375 nm or more, 380 nm or more, 385 nm or more, or 390 nm or more, provided that the upper limit of the range does not exceed 395 nm. Alternatively, or in addition, the wavelength of light can be within a range of 395 nm or less, e.g., 390 nm or less, 385 nm or less, 380 nm or less, 375 nm or less, 370 nm or less, 365 nm or less, 360 nm or less, 355 nm or less, 350 nm or less, 345 nm or less, 340 nm or less, 335 nm or less, 330 nm or less, 325 nm or less, 320 nm or less, 315 nm or less, 310 nm or less, 305 nm or less, 300 nm or less, 295 nm or less, 290 nm or less, 285 nm or less, 280 nm or less, 275 nm or less, 270 nm or less, 265 nm or less, 260 nm or less, or 255 or less, provided that the lower limit of the range is at least 250 nm. Thus, the wavelength of light used for detecting a polishing endpoint in situ can be bounded by any two of the foregoing endpoints. For example, the wavelength of light used for detecting a polishing endpoint in situ can be from 250 nm to 300 nm, 280 nm to 325 nm, or 350 nm to 395 nm. Moreover, any of the individual wavelengths can be combined with any of the wavelength ranges when describing the light that is used to detect a polishing endpoint in situ.

In another embodiment, the light that is used to irradiate the polishing pad and workpiece assembly during polishing for endpoint detection can comprise one or more single wavelengths (e.g., 395 nm, 400 nm, 425 nm, 450 nm, 475 nm, 500 nm, 525 nm, 550 nm, 575 nm, 600 nm, 625 nm, 650 nm, 675 nm, 700 nm, 725 nm, 750 nm, 775 nm, 800 nm, 825 nm, 850 nm, 875 nm, 900 nm, 925 nm, 950 nm, 975 nm, 1,000 nm, 2,000 nm, 5,000 nm, 10,000 nm, 20,000 nm, 30,000 nm, or 35,000 nm), and/or the light can comprise one or more ranges of wavelengths in a range of 395 nm to 35,000 nm. For example, the wavelength of light can be within the range of 395 nm or more, e.g., 400 nm or more, 425 nm or more, 450 nm or more, 475 nm or more, 500 nm or more, 525 nm or more, 550 nm or more, 575 nm or more, 600 nm or more, 625 nm or more, 650 nm or more, 675 nm or more, 700 nm or more, 725 nm or more, 750 nm or more, 775 nm or more, 800 nm or more, 825 nm or more, 850 nm or more, 875 nm or more, 800 nm or more, 825 nm or more, 850 nm or more, 875 nm or more, 900 nm or more, 925 nm or more, 950 nm or more, 975 nm or more, 1000 nm or more, 2000 nm or more, 3000 nm or more, 4000 nm or more, 5000 nm or more, 6000 nm or more, 7000 nm or more, 8000 nm or more, 9000 nm or more, 10,000 nm or more, 15,000 nm or more, 20,000 nm or more, 25,000 nm or more, or 30,000 nm or more, provided that the upper limit of the range does not exceed 35,000 nm. Alternatively, or in addition, the wavelength of light can be within the range of 35,000 nm or less, e.g., 30,000 nm or less, 25,000 nm or less, 20,000 nm or less, 15,000 nm or less, 10,000 nm or less, 9,000 nm or less, 8,000 nm or less, 7,000 nm or less, 6,000 nm or less, 5,000 nm or less, 4,000 nm or less, 3,000 nm or less, 2,000 nm or less, 1,000 nm or less, 975 nm or less, 950 nm or less, 925 nm or less, 900 nm or less, 875 nm or less, 850 nm or less, 825 nm or less, 800 nm or less, 775 nm or less, 750 nm or less, 725 nm or less, 700 nm or less, 675 nm or less, 650 nm or less, 625 nm or less, 600 nm or less, 575 nm or less, 550 nm or less, 525 nm or less, 500 nm or less, 475 nm or less, 450 nm or less, 425 nm or less, or 400 nm or less, provided that the lower limit of the range is at least 395 nm. Thus, the wavelength of light used for detecting a polishing endpoint in situ can be within a wavelength range bounded by any two of the foregoing endpoints. For example, the wavelength of light can be 495 nm to 10,000 nm, 800 nm to 2,000 nm, or 400 nm to 800 nm. Moreover, any of the individual wavelengths can be combined with any of the wavelength ranges when describing the light that is used to detect a polishing endpoint in situ.

When detecting a polishing endpoint in situ, any of the foregoing singular wavelengths or wavelength ranges recited for light in the overall ranges of 250 nm to 395 nm and 395 nm to 35,000 nm can be combined in any suitable manner in order to detect a polishing endpoint in situ. For example, detecting a polishing endpoint in situ can comprise utilizing light having wavelengths of 350 nm to 395 nm and 400 nm to 800 nm, 250 nm to 305 nm and 425 nm to 775 nm, 525 nm to 650 nm and 800 nm to 1,000 nm, or 350 nm and 380 nm to 395 nm and 425 nm to 675 nm. In a preferred embodiment, the light that is used to irradiate the polishing pad and workpiece assembly during polishing for endpoint detection has a wavelength in a range of 250 nm to 395 nm and 400 nm to 800 nm.

The polishing composition utilized with the inventing polishing pad can be any suitable polishing composition. The polishing composition typically comprises an aqueous carrier, a pH adjustor, and optionally an abrasive. Depending on the type of workpiece being polished, the polishing composition optionally can further comprise oxidizing agents, organic or inorganic acids, complexing agents, pH buffers, surfactants, corrosion inhibitors, anti-foaming agents, and the like.

The following examples further illustrate the invention but, of course, should not be construed as in any way limiting its scope.

EXAMPLES

In these examples, ultraviolet light irradiation was performed using a 100 watt mercury vapor lamp at an intensity of at least about 1,000 mW/cm$^2$ for a duration of four minutes. This protocol simulates 5-10 million light flashes that typically would be used in a white light endpoint detection system (e.g., the FullVision system available from Advanced Materials) during a typical production run of polishing about 1000 wafers. The simulated light irradiation can be performed, for example, using equipment available from UVEXS, which equipment provides high intensity ultraviolet and visible light energy. The 100 watt mercury vapor lamp used in the UVEXS system is capable of producing high intensity light (typically in excess of 1,000 mW/cm$^2$) in a wavelength range of 300 nm to 800 nm, with an ultraviolet energy peak at 365 nm.

Ultraviolet-visible spectra were recorded using an Agilent 8453 ultraviolet-visible spectrometer at a resolution of 1 nm.

Example 1

This example illustrates a polishing pad of the invention having a light-transmitting region that is composed of a material comprising a polymeric resin and that has a suitable total light transmittance.

Two polishing pads comprising a polishing pad body and a light-transmitting region were prepared. The resulting two polishing pads contained (a) a polishing pad body comprised of a first polymeric resin and (b) a substantially nonporous light-transmitting region comprised of a second polymeric resin without a light-absorbing compound and having a thickness of about 1 mm. The first polymeric resin was a conventional methylenediphenyl diisocyanate-based thermoplastic polyurethane (i.e., an MDI-based TPU) having the chemical structure depicted below.

The first polishing pad was prepared by foaming a highly porous polishing pad body using a micro cellular foaming process as described in U.S. Pat. No. 6,896,593, herein incorporated by reference in its entirety. A portion of the polishing pad then was removed so as to obtain a polishing pad body containing an empty void. The light-transmitting region was separately formed using an injection molding technique from the second polymeric resin, in which the second polymeric resin had a Shore hardness of 42 D (i.e., about 87 A). The light-transmitting region was substantially nonporous and had a Shore hardness of 65 A. The light-transmitting region was trimmed to match the size of the void in the polishing pad body, placed in the void, and then attached to the polishing pad body within the void using a combination of ultrasonic and RF welding techniques. The second polishing pad was formed in an identical manner, except that the light-transmitting region was formed from a second polymeric resin having a Shore hardness of 55 D (i.e., about 92 A).

Figure 3:
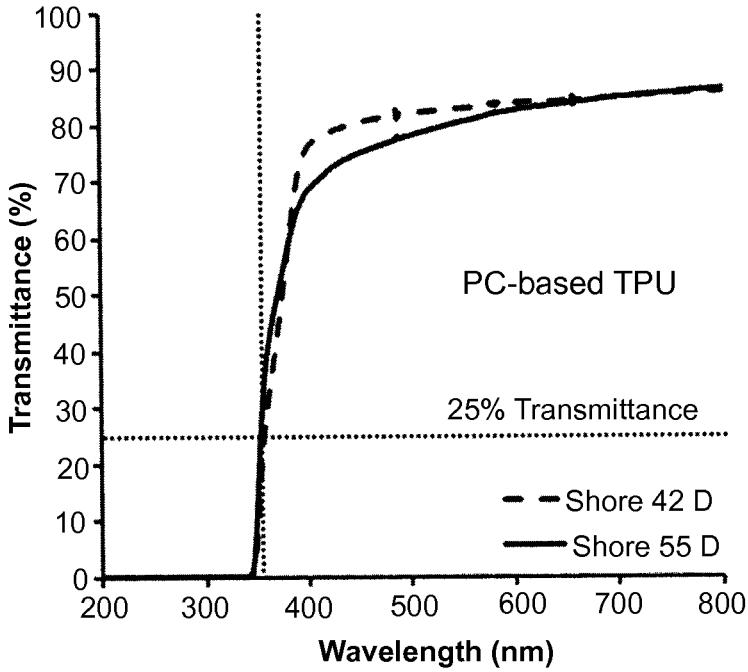
FIG. 3 depicts ultraviolet-visible spectra of two polishing pads comprising light-transmitting regions having different Shore hardnesses. The light-transmitting regions comprise a polymeric resin that is suitable for use in the invention. The light-transmitting regions do not contain a light-absorbing compound.

Ultraviolet-visible spectra were recorded for the light-transmitting regions of the two polishing pads and are depicted in FIG. 3. The light-transmitting region of each of the two polishing pads had total light transmittances of about 25% or more at one or more wavelengths in a range of 250 nm to 395 nm. Specifically, the light-transmitting regions of the first and second polishing pads had a total light transmittance of about 25% or more at wavelengths of about 357 nm or more and about 353 nm or more, respectively.

Example 2

This example illustrates a polishing pad of the invention having a light-transmitting region that is composed of a material comprising a polymeric resin with and without a light-absorbing compound.

Two polishing pads comprising a polishing pad body and a light-transmitting region were prepared. The resulting two polishing pads contained (a) a polishing pad body comprised of a first polymeric resin and (b) a substantially nonporous light-transmitting region comprised of a second polymeric resin with and without a light-absorbing compound and having a thickness of about 1 mm. The first polishing pad did not have a light-absorbing compound present in the light-transmitting region, while the second polishing pad had a light-absorbing compound in the light-transmitting region in an amount of 0.5 wt. % based on the weight of the light-transmitting region. The first polymeric resin was the methylenediphenyl diisocyanate-based thermoplastic polyurethane

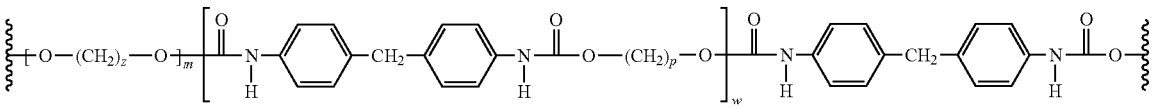

The second polymeric resin was a polycarbonate-based thermoplastic polyurethane (i.e., a PC-based TPU) having the chemical structure depicted below.

(i.e., an MDI-based TPU) of Example 1. The second polymeric resin was the polycarbonate-based thermoplastic polyurethane (i.e., an PC-based TPU) of Example 1 having a

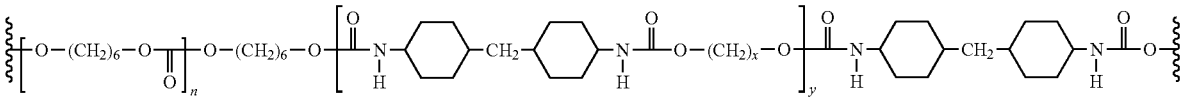

Shore hardness of 55 D (i.e., about 92 A). The light-absorbing compound was 2-ethylhexyl-p-methoxycinnamate (e.g., UVINUL™ 3088).

The first polishing pad, which did not contain a light-absorbing compound, was prepared using the same method described in Example 1. The second polishing pad, which contained the light-absorbing compound, was prepared in a similar manner except that the second polymeric resin was melt blended with the light-absorbing compound and then formed into the light-transmitting region using an injection molding technique. The light-transmitting region was substantially nonporous. The light-transmitting region was attached to the polishing pad body in the same manner as described in Example 1.

Figure 4:
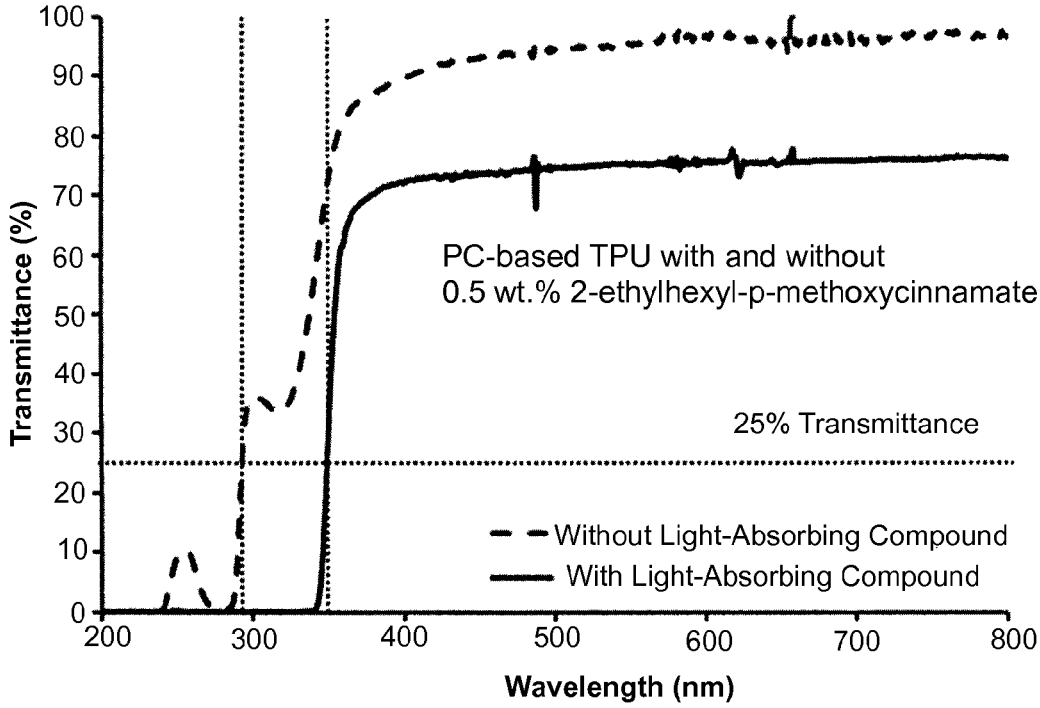
FIG. 4 depicts ultraviolet-visible spectra of two polishing pads comprising light-transmitting regions. The light-transmitting regions of both polishing pads comprise a polymeric resin that is suitable for use in the invention, and only one of the light-transmitting regions comprises a light-absorbing compound.

Ultraviolet-visible spectra were recorded for the light-transmitting regions of the two polishing pads and are depicted in FIG. 4. The light-transmitting region of each of the two polishing pads had total light transmittances of about 25% or more at one or more wavelengths in a range of 250 nm to 395 nm. Specifically, the light-transmitting region of the first polishing pad, which did not contain the light-absorbing compound, had a total light transmittance of about 25% or more at wavelengths of 293 nm or more, and the light-transmitting region of the second polishing pad, which contained the light-absorbing compound, had a total light transmittance of about 25% or more at wavelengths of 349 nm or more. Thus, a suitable level of total light transmittance (e.g., about 25% or more) in the desired range (250 to 395 nm) was maintained even with the inclusion of the light-absorbing compound.

Example 3

This example illustrates the total light transmittance of a polishing pad of the invention having a light-transmitting region that is composed of a material comprising a polymeric resin and a light-absorbing compound.

Two polishing pads comprising a polishing pad body and a light-transmitting region were prepared in the manner described in Example 2. The resulting two polishing pads contained (a) a polishing pad body comprised of a first polymeric resin and (b) a substantially nonporous light-transmitting region comprised of a second polymeric resin with and without a light-absorbing compound and having a thickness of about 1 mm. The first polymeric resin was the methylenediphenyl diisocyanate-based thermoplastic polyurethane (i.e., an MDI-based TPU) of Example 1. The second polymeric resin was the polycarbonate-based thermoplastic polyurethane (i.e., a PC-based TPU) of Example 1 having a Shore hardness of 55 D (i.e., about 92 A). The light-absorbing compound in the first polishing pad was 2-hydroxy-4-n-octoxybenzophenone (e.g., CYASORB™ UV-531), and the light-absorbing compound in the second polishing pad was pentaerythritol tetrakis(2-cyano-3,3-diphenylacrylate) (e.g., UVINUL™ 3030). The light-absorbing compound was present in the light-transmitting region in an amount of 0.5 wt. % based on the weight of the light-transmitting region.

Figure 5A:
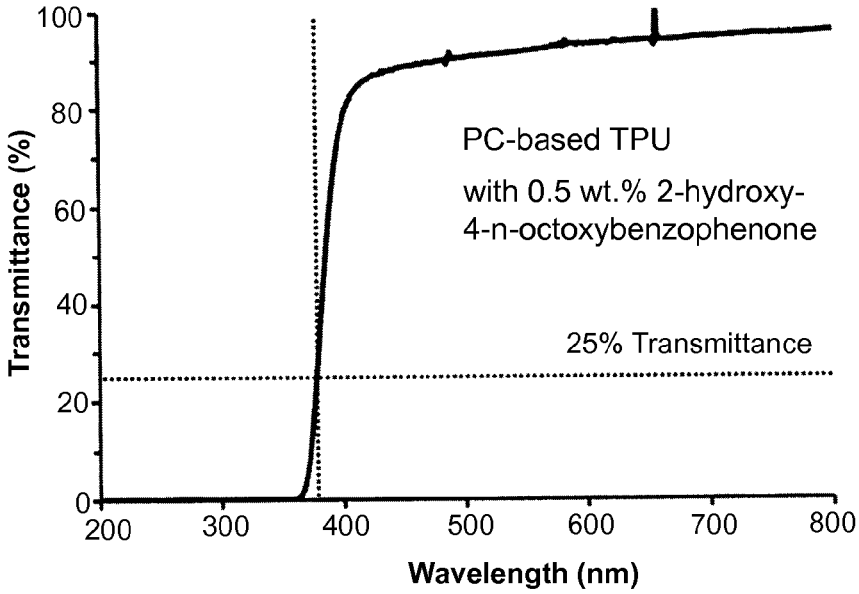
FIG. 5A and FIG. 5B depict ultraviolet-visible spectra of polishing pads comprising light-transmitting regions prepared in accordance with the invention.
Figure 5B:
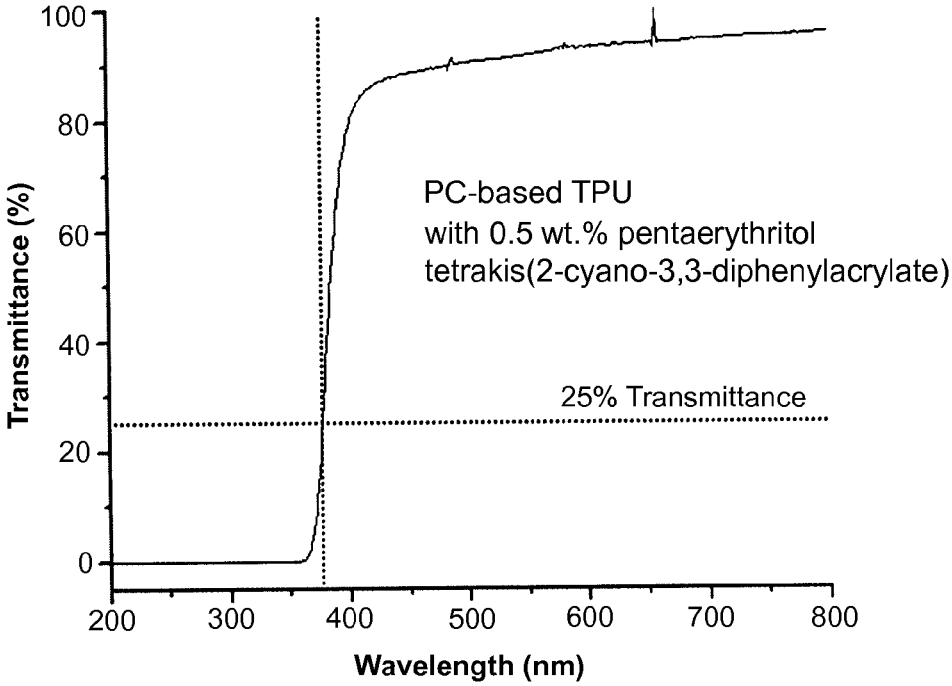

Ultraviolet-visible spectra were recorded for the light-transmitting regions of the two polishing pads and are depicted in FIG. 5A and FIG. 5B, respectively. The light-transmitting region of each of the two polishing pads had a total light-transmittance of about 25% or more at one or more wavelengths in a range of 250 nm to 395 nm. Specifically, the light-transmitting region of the first polishing pad had a total light transmittance of about 25% or more at wavelengths of 377 nm or more (see FIG. 5A), and the light-transmitting region of the second polishing pad had a total light transmittance of about 25% or more at wavelengths of about 380 nm or more (see FIG. 5B). A suitable level of total light transmittance (e.g., about 25% or more) in the desired range (250 to 395 nm) was achieved using the polycarbonate-based thermoplastic polyurethane in combination with either of the light-absorbing compounds for the light-transmitting region.

Example 4

This example illustrates the effect of ultraviolet light irradiation on a polishing pad of the invention having a light-transmitting region that is composed of a material comprising a polymeric resin and a light-absorbing compound.

Figure 6:
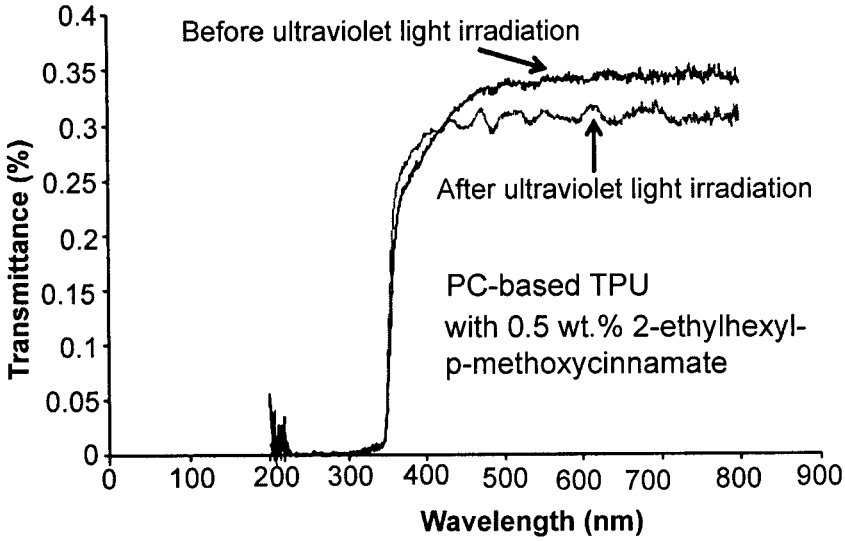
FIG. 6 depicts ultraviolet-visible spectra of a polishing pad comprising a light-transmitting region prepared in accordance with the invention both prior to and after ultraviolet light irradiation.

Ultraviolet-visible spectra were recorded for the light-transmitting region of the polishing pad of Example 2, both prior to and after ultraviolet light irradiation, and are depicted in FIG. 6. The protocol used for ultraviolet light irradiation is described hereinabove.

As depicted in FIG. 6, prior to ultraviolet light irradiation, the light-transmitting region of the polishing pad had a total light-transmittance of about 25% or more at one or more wavelengths in a range of 250 nm to 395 nm. Specifically, the light-transmitting region of the polishing pad had a total light transmittance of about 25% at wavelengths of about 350 nm or more prior to ultraviolet light irradiation.

After ultraviolet light irradiation, as depicted in FIG. 6, the light-transmitting region maintained a total light transmittance of about 25% or more in a range of 250 nm to 395 nm, specifically at wavelengths of 350 mm or more. The total light transmittance of the light-transmitting region prior to ultraviolet light irradiation differed from the total light transmittance of the light-transmitting region after ultraviolet light irradiation by about 30% or less at one or more wavelengths in a range of 250 nm to 395 nm and/or 395 nm to 35,000 nm. Specifically, the total light transmittance difference is about 5% or less within the entire range of 250 nm to 800 nm, indicating a high stability to ultraviolet light.

Example 5

This example illustrates a polishing pad having a light-transmitting region that is composed of a material comprising a polymeric resin that is not within the scope of the invention, both with and without the presence of a conventional unsuitable light-absorbing compound.

Two polishing pads comprising a polishing pad body and a light-transmitting region were prepared in the manner described in Examples 1 and 2, respectively. The resulting two polishing pads contained (a) a polishing pad body comprised of a first polymeric resin and (b) a substantially nonporous light-transmitting region comprised of a second polymeric resin with and without a light-absorbing compound and having a thickness of about 1 mm. The first polishing pad did not have a light-absorbing compound present in the light-transmitting region, while the second polishing pad had a light-absorbing compound in the light-transmitting region in an amount of 0.5 wt. % based on the weight of the light-transmitting region. The first polymeric resin was the methylenediphenyl diisocyanate-based thermoplastic polyurethane (i.e., an MDI-based TPU) of Example 1. The second polymeric resin was a polycaprolactam-based aliphatic thermoplastic polyurethane having the chemical structure depicted below.

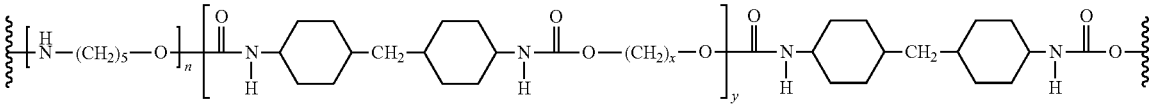

The light-absorbing compound was 2-(2H-benzotriazol-2-yl)-4,6-di-tert-pentylphenol (e.g., TINUVIN™ 328).

Figure 7:
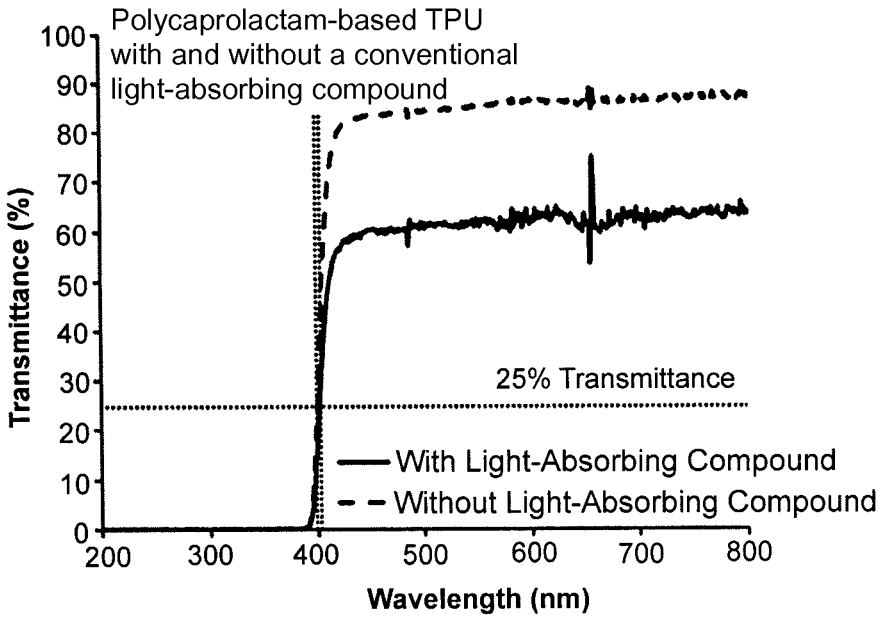
FIG. 7 depicts ultraviolet ultraviolet-visible spectra of two polishing pads comprising light-transmitting regions. The light-transmitting regions of both polishing pads comprise a polymeric resin that is not suitable for use in the invention. One of the light-transmitting regions comprises a conventional light-absorbing compound that is not suitable for use in the invention.

Ultraviolet-visible spectra were recorded for the light-transmitting regions of the two polishing pads and are depicted in FIG. 7. The light-transmitting regions of both polishing pads had total light transmittances of less than 25% in a wavelength range of 250 nm to 395 nm. In particular, the light-transmitting region of the first polishing pad, i.e., without the light-absorbing compound, had a total light transmittance of about 25% or more at wavelengths of 399 nm or more, and the light-transmitting region of the second polishing pad, i.e., with the light-absorbing compound, had a total light transmittance of about 25% or more at wavelengths of 401 nm or more. Thus, a suitable level of total light transmittance (e.g., about 25% or more) in the desired range (e.g., 250 to 395 nm) was not achieved with the polycaprolactam-based thermoplastic polyurethane with or without the light absorbing compound.

Example 6

This example illustrates that a polishing pad having a light-transmitting region composed of a polymeric resin and a light-absorbing compound that has an undesirable total light transmittance.

A polishing pad comprising a polishing pad body and a light-transmitting region was prepared in a manner similar to the manner described in Example 2. The resulting polishing pad contained (a) a polishing pad body comprised of a polymeric resin and (b) a substantially nonporous light-transmitting region comprised of the same polymeric resin and a light-absorbing compound and having a thickness of about 1 mm. The polymeric resin was the methylenediphenyl diisocyanate-based thermoplastic polyurethane (i.e., an MDI-based TPU) of Example 1. The light-absorbing compound was 2-(2H-benzotriazol-2-yl)-4,6-di-tert-pentylphenol (e.g., TINUVIN™ 328).

Figure 8:
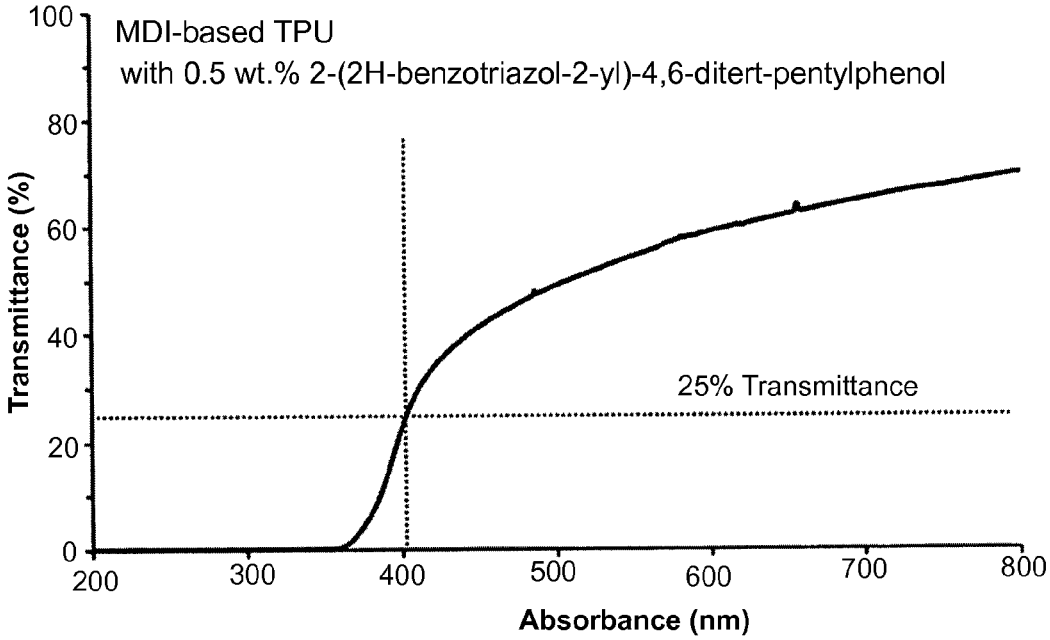
FIG. 8 depicts an ultraviolet-visible spectrum of a polishing pad comprising a light-transmitting region. The light-transmitting region comprises a conventional polymeric resin and a light-absorbing compound, both of which are not suitable for use in the invention.

An ultraviolet-visible spectrum was recorded for the light-transmitting region and is depicted in FIG. 8. The light-transmitting region had a total light transmittance of less than 25% in a wavelength range of 250 nm to 395 nm. Rather, the light-transmitting region had a total light transmittance of about 25% or more at wavelengths of 402 nm or more.

Example 7

This example illustrates a polishing pad having a light-transmitting region composed of a polymeric resin not containing a light-absorbing compound that has a significant decrease in total light transmittance after ultraviolet light irradiation.

A polishing pad comprising a polishing pad body and a light-transmitting region was prepared in the same manner described in Example 6, except that the light-transmitting region did not contain a light-absorbing compound.

Figure 9:
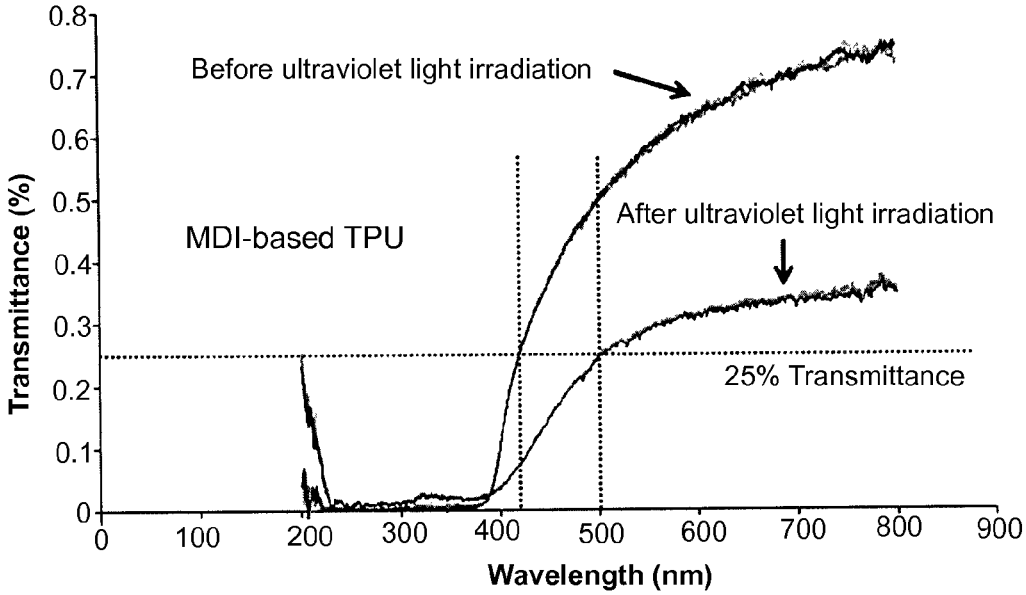
FIG. 9 depicts ultraviolet ultraviolet-visible spectra of a polishing pad comprising a light-transmitting region. The light-transmitting region comprises a conventional polymeric resin not suitable for use in the invention, and the light-transmitting region does not comprise a light-absorbing compound. Ultraviolet-visible spectra were recorded both prior to and after ultraviolet light irradiation.

Ultraviolet-visible spectra were recorded for the light-transmitting region, both prior to and after ultraviolet light irradiation (three measurements each) as described hereinabove and are depicted in FIG. 9.

Prior to ultraviolet light irradiation, the light-transmitting region did not have a total light-transmittance of about 25% or more at one or more wavelengths in a range of 250 nm to 395 nm. Rather, the light-transmitting region had a total light transmittance of less than 25% at wavelengths of about 410 nm or less prior to ultraviolet light irradiation.

After ultraviolet light irradiation, the total light transmittance of the light-transmitting region significantly deteriorated. Specifically, the light-transmitting region had a total light transmittance of less than 25% at wavelengths of about 500 nm or less. Moreover, the total light transmittance of the light-transmitting region prior to ultraviolet light irradiation differed from the total light transmittance of the light-transmitting region after ultraviolet light irradiation by about 20% at 415 nm (from about 25% to about 5% total light transmittance), and the total light transmittance difference increased at longer wavelengths, up to a maximum difference of about 40% at 800 nm.

Example 8

This example illustrates the discoloration of a polishing pad containing a light-transmitting region.

Figure 10:
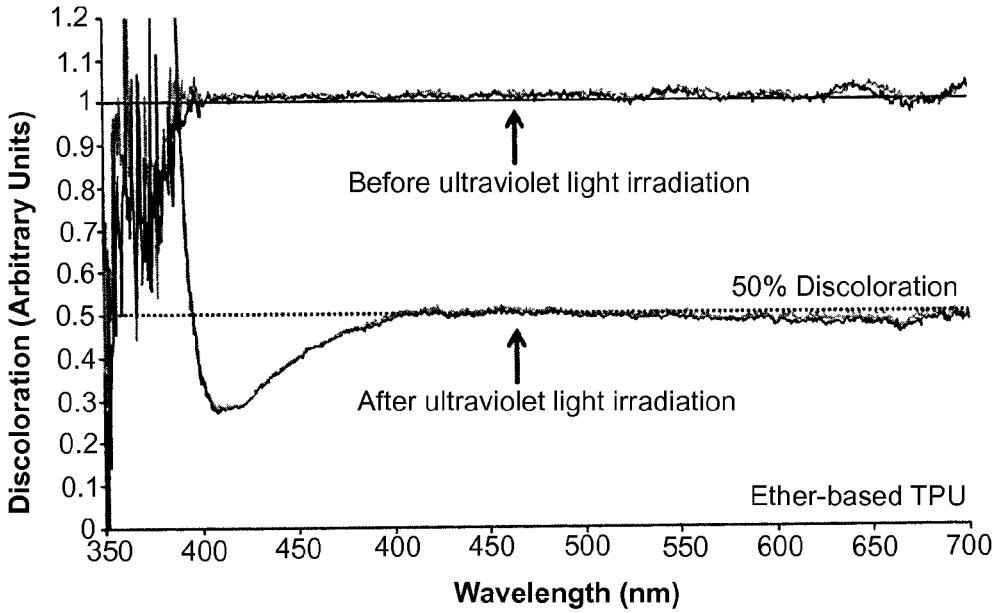
FIG. 10 depicts ultraviolet ultraviolet-visible spectra of a conventional commercial polishing pad comprising a light-transmitting region. The light-transmitting region comprises a conventional polymeric resin that is not suitable for use in the invention, and the light-transmitting region does not contain a light-absorbing compound. The spectra show the discoloration of the light-transmitting region upon ultraviolet light irradiation.

A commercially available polishing pad was evaluated, which was comprised of an ether-based thermoplastic polyurethane (i.e., an ether-based TPU) and no light-absorbing compound. Ultraviolet-visible spectra were recorded for the light-transmitting region of the polishing pad both prior to and after ultraviolet light irradiation (three measurements each) as described hereinabove and are depicted in FIG. 10. The degree of discoloration of the light-transmitting region was measured according to ASTM D1148-95.

Ultraviolet light irradiation resulted in the discoloration of the light-transmitting region by more than 50% in a wavelength range of 395 nm to 800 nm.

Example 9

This example illustrates the total light transmittance of a light-transmitting region in a polishing pad before and after being used in a production run to polish numerous wafers while using a white light endpoint detection system.

A polishing pad comprising a polishing pad body and a light-transmitting region was prepared in a manner similar to the manner described in Example 2. The resulting polishing pad contained (a) a polishing pad body comprised of a first polymeric resin and (b) a substantially nonporous light-transmitting region comprised of a second polymeric resin and a light-absorbing compound and having a thickness of about 1 mm. The first polymeric resin was the methylenediphenyl diisocyanate-based thermoplastic polyurethane (i.e., an MDI-based TPU) of Example 1. The second polymeric resin was the polycarbonate-based thermoplastic polyurethane (i.e., a PC-based TPU) of Example 1 having a Shore hardness of 42 D (i.e., about 87 A). The light-absorbing compound was 2-ethylhexyl-p-methoxycinnamate (e.g., UVINUL™ 3088), which was present in an amount of 0.5 wt. % based on the weight of the light-transmitting region.

Figure 11:
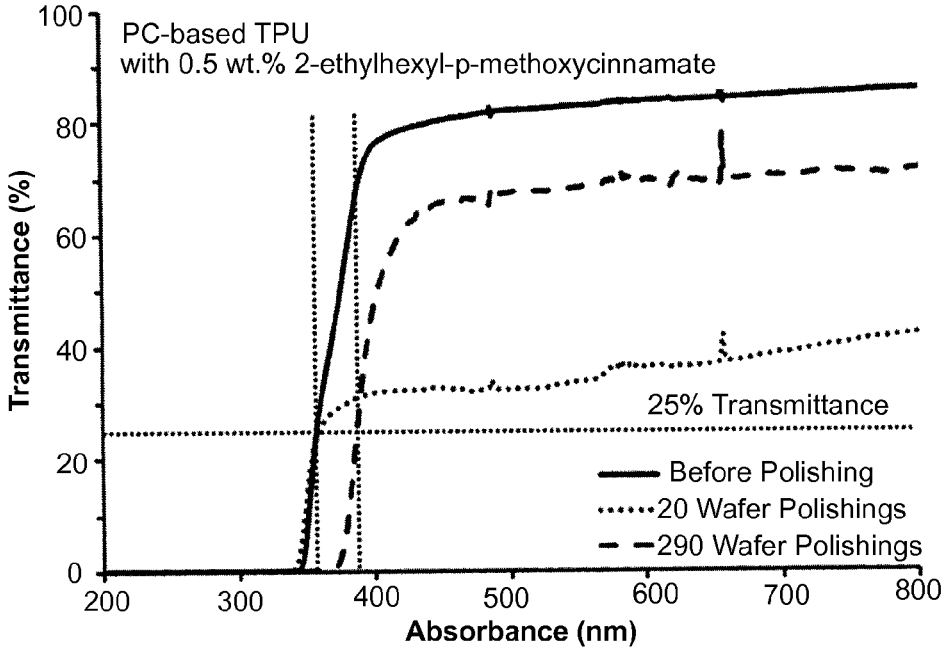
FIG. 11 depicts ultraviolet visible spectra of a polishing pad prepared in accordance with the invention both prior to and after a number of actual wafer polishings. The polishing was performed while using a white light in situ endpoint detection system.

Ultraviolet-visible spectra were recorded for the light-transmitting region, before and after polishing various numbers of wafers with the polishing pad, and are depicted in FIG. 11. Prior to polishing any wafers, the light-transmitting region had a total light transmittance of about 25% or more at wavelengths of 350 nm or more. After polishing 20 wafers, the light-transmitting region maintained a total light transmittance of about 25% or more at wavelengths of 350 nm or more. After polishing 290 wafers, the light-transmitting region still had a satisfactory total light transmittance of about 25% or more at wavelengths of 385 nm or more.

The results of this example demonstrate that a light-transmitting region of the invention maintains a satisfactory total light transmittance upon polishing numerous wafers while using a white light endpoint detection system.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A polishing pad comprising at least one light-transmitting region, wherein the light-transmitting region is composed of a material comprising (a) a polymeric resin and (b) at least one light-absorbing compound, and wherein the light-transmitting region has a total light transmittance of 25% or more at one or more wavelengths in a range of 250 nm to 395 nm, wherein the light-transmitting region is discolored 45% or less at one or more wavelengths in a range of 395 nm to 800 nm upon ultraviolet light irradiation, as measured according to ASTM D1148-95.

2. The polishing pad of claim 1, wherein the total light transmittance of the light-transmitting region prior to ultraviolet light irradiation differs from the total light transmittance of the light-transmitting region after ultraviolet light irradiation by 30% or less at one or more wavelengths in a range of 250 nm to 395 nm and/or 395 nm to 35,000 nm, and wherein the ultraviolet light irradiation comprises irradiating the light-transmitting region with a 100 watt mercury vapor lamp at an intensity of at least 1,000 mW/cm$^2$ for a duration of four minutes.

3. The polishing pad of claim 1, wherein the light-transmitting region has a total light transmittance of 25% or more at one or more wavelengths in a range of 250 nm to 395 nm and/or 395 nm to 35,000 nm after the light-transmitting region has been exposed to ultraviolet light irradiation, and wherein the ultraviolet light irradiation comprises irradiating the light-transmitting region with a 100 watt mercury vapor lamp at an intensity of at least 1,000 mW/cm$^2$ for a duration of four minutes.

4. The polishing pad of claim 1, wherein a solution consisting of the light-absorbing compound at a concentration of 10 mg/L has an absorbance of 0.5 or less in a range of 330 nm to 400 nm.

5. The polishing pad of claim 1, wherein a solution consisting of the tight-absorbing compound does not have a maximum light absorption located in a range of 335 nm to 400 nm.

6. The polishing pad of claim 1, wherein the light-transmitting region has a total light transmittance of 25% or more at one or more wavelengths in a range of 395 nm to 35,000 nm.

7. The polishing pad of claim 1, wherein the light-transmitting region has a total light transmittance of 25% or more at one or more wavelengths in a range of 360 nm to 380 nm.

8. The polishing pad of claim 1, wherein the light-transmitting region comprises 50% or more of the polishing pad by surface area.

9. The polishing pad of claim 1, wherein the polymeric resin is a thermoplastic polymeric resin.

10. The polishing pad of claim 1, wherein the polymeric resin comprises at least one aliphatic polymer selected from the group consisting of polyurethanes, polycarbonate-based polyurethanes, polycarbonate-based diol or triol polyurethanes, linear aliphatic polycarbonate-based polyurethanes, branched aliphatic polycarbonate-based polyurethanes, cycloalkane-based aliphatic polyurethanes, polysiloxane-based polyurethanes, (alkyl)acrylates, (alkyl)acrylic acids, polyvinylidene fluorides, polyvinylidene difluorides, polychlorotrifluoroethylenes, polysiloxanes, polycarbonates, linear aliphatic polycarbonates, polymethylpentene-1, and combinations thereof.

11. The polishing pad of claim 10, wherein the aliphatic polymer is a thermoplastic polymer, a thermoset polymer, or any combination thereof.

12. The polishing pad of claim 11, wherein the thermoplastic polymer is selected from the group consisting of thermoplastic polyurethanes, polycarbonate-based thermoplastic polyurethanes, cycloalkane-based thermoplastic polyurethanes, polysiloxane-based thermoplastic polyurethanes, random copolymers thereof, block copolymers thereof, and blends thereof.

13. The polishing pad of claim 10, wherein the aliphatic polymer is a polyurethane comprising monomeric units of (a) one or more diols selected from the group consisting of a polyol, a polyol comprising cyclic aliphatic rings, a polycarbonate polyol, a polyhexamethylene carbonate diol comprising 1 to 1000 repeat units, a polyethylene ether carbonate diol comprising 1 to 1000 repeat units, 1,12-dodecanediol, 1,4-butanediol, and combinations thereof, and (b) dicyclohexylmethane 4,4'-diisocyanate.

14. The polishing pad of claim 1, wherein the light-absorbing compound is selected from the group consisting of pentaerythritol tetrakis(2-cyano-3,3-diphenylacrylate), 2-ethylhexyl-p-methoxycinnamate, ethyl-2-cyano-3,3'-diphenylacrylate, octyl-p-methoxycinnamate, 4-aminobenzoate-trialkylorthoformate, ethyl(4-ethoxycarbonylphenyl)-N-methyl-N-phenylformamidine, N,N-bis-(4-ethoxycarbonylphenyl)-N-methylformamidine, N2-(4-ethoxycarbonylphenyl)-N1-methyl-N1-phenylformamidine, 2-hydroxy-4-n-octoxybenzophenone, 2-propenoic acid-3-(4-methoxyphenyl)-2-ethylhexyl ester, ethyl-2-cyano-3,3-diphenylacrylate, 2-ethylhexyl-3,3-diphenylacrylate, ethyl-3,3-bis(4-methoxyphenyl)acrylate, 2-ethylhexyl-2-cyano-3,3-diphenylacrylate, homomethyl salicylate, 2-phenylbenzimidazole-5-sulphonic acid, triethyl salicylate, octyldimethyl 4-aminobenzoic acid, 4-methylbenzilidene camphor, di-2'-ethylhexyl-3,5-dimethoxy-4-hydroxy benzylidene malonate, cyanoacrylates, triazines, bis-methines, camphor derivatives, and combinations thereof.

15. The polishing pad of claim 1, wherein the light-transmitting region has a thickness of 0.2 mm to 3 mm.

16. The polishing pad of claim 1, wherein the light-transmitting region has one or more of the following properties:

(a) a Shore hardness of 10 A to 80 D, (b) a porosity of 0.1% to 10%, wherein 50% or more of the pores of the light-transmitting region have a size of 1 μm or less, (c) a % elongation of 50% or more, (d) an ultimate tensile strength of 65 kPa or more, (e) a flexural modulus at room temperature of 700 kPa to 3,500,000 kPa, (f) a resin melt index or melt flow rate of less than 500 g/10 min at 2160 g load at 210° C., (g) a resin melt viscosity range of 10 Pa·s to 20,000 Pa·s., as measured by a capillary rheometer at a shear rate of 18/s at 210° C., (h) a % crystallinity of less than 30%, (i) a glass transition temperature of about −100° C. to 160° C., (j) a surface roughness of 0.1 to 100 μm, and (k) a refractive index of 1.1 to 2.0.

17. The polishing pad of claim 1, wherein the polishing pad further comprises a polishing pad body.

18. The polishing pad of claim 17, wherein the polishing pad body has one or more of the following properties:

(a) a Shore hardness of 10 A to 80 D, (b) a porosity of 0.1% to 80%, wherein 50% or more of the pores of the polishing pad have a size of 200 μm or less, (c) a % elongation of 50% or more, (d) an ultimate tensile strength of 65 kPa or more, (e) a flexural modulus at room temperature of 700 kPa to 3,500,000 kPa, (f) a resin melt index or melt flow rate of less than 500 g/10 min at 2160 g load at 210° C., (g) a resin melt viscosity range of 10 Pa·s to 20,000 Pa·s., as measured by a capillary rheometer at a shear rate of 18/s at 210° C., (h) a % crystallinity of 0% to 60%, (i) a glass transition temperature of about −100° C. to 160° C., (j) a surface roughness of 0.1 to 100 μm, and (k) a refractive index of 1.1 to 2.0.

19. The polishing pad of claim 17, wherein the light-transmitting region is attached to the polishing pad body by a process selected from the group consisting of heat-melting chemical bond fusion, ultrasonic welding, radio frequency welding, arc welding, heat compression, frictional heating, and combinations thereof.

20. The polishing pad of claim 17, wherein the polishing pad, polishing pad body, and/or light-transmitting region is formed by film or sheet extrusion, injection molding, blow molding, thermoforming, compression molding, co-extrusion molding, reaction injection molding, profile extrusion molding, rotational molding, gas injection molding, film insert molding, foaming, casting, or any combination thereof.

21. The polishing pad of claim 1, wherein the light-transmitting region is formed by compressing at least a portion of the polishing pad.

22. The polishing pad of claim 1, wherein the light-absorbing compound is present in an amount of 0.05% to 20% by weight based on the weight of the light-transmitting region.

23. The polishing pad of claim 1, wherein the polymeric resin is an aliphatic polycarbonate-based thermoplastic polyurethane comprising monomeric units of (a) a polyakylene carbonate diol comprising 1 to 1000 repeat units, (b) an aliphatic diisocyanate, and (c) an alkyl diol different from the polyalkylene carbonate diol (a), a solution consisting of the light-absorbing compound at a concentration of 10 mg/L has an absorbance of 0.5 or less in a range of 330 nm to 400 nm, the light-transmitting region has a total light transmittance of 25% or more at one or more wavelengths in a range of 360 nm to 380 nm, the light-transmitting region is discolored 45% or less at one or more wavelengths in a range of 395 nm to 800 nm upon ultraviolet light irradiation, as measured according to ASTM D1148-95, and the light-transmitting region has a total light transmittance of 25% or more at one or more wavelengths in a range of 250 nm to 395 nm after the light-transmitting region has been exposed to ultraviolet light irradiation, and wherein the ultraviolet light irradiation comprises irradiating the light-transmitting region with a 100 watt mercury vapor lamp at an intensity of at least 1,000 mW/cm$^2$ for a duration of four minutes.

24. A method of polishing a workpiece comprising:

(a) providing a workpiece to be polished, (b) contacting the workpiece with the polishing pad of claim 1 and a chemical-mechanical polishing composition, and (c) moving the workpiece relative to the polishing pad so as to abrade at least a portion of the surface of the workpiece to polish the workpiece.

25. The method of claim 24, wherein the method further comprises detecting a polishing endpoint in situ using light.

* * * * *

UNITED STATES PATENT AND TRADEMARK OFFICE

CERTIFICATE OF CORRECTION

PATENT NO. : 9,156,125 B2
APPLICATION NO. : 13/444620
DATED : October 13, 2015
INVENTOR(S) : Abaneshwar Prasad It is certified that error appears in the above-identified patent and that said Letters Patent is hereby corrected as shown below:

In the Claims:

Column 42, Claim 5, line 28, delete "tight-absorbing" and insert --light-absorbing--.

Signed and Sealed this
Twenty-fourth Day of May, 2016

Michelle K. Lee

Michelle K. Lee
*Director of the United States Patent and Trademark Office*